US007399568B2

(12) United States Patent
Fukui et al.

(10) Patent No.: US 7,399,568 B2
(45) Date of Patent: Jul. 15, 2008

(54) CARRIER FOR ELECTROPHOTOGRAPHIC DEVELOPER

(75) Inventors: Tatsuki Fukui, Yokohama (JP); Tetsuya Yano, Atsugi (JP); Takashi Kenmoku, Fujisawa (JP); Chieko Mihara, Isehara (JP); Ako Kusakari, Atsugi (JP); Norikazu Fujimoto, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 298 days.

(21) Appl. No.: 11/165,373

(22) Filed: Jun. 24, 2005

(65) Prior Publication Data

US 2005/0287463 A1 Dec. 29, 2005

(30) Foreign Application Priority Data

Jun. 25, 2004 (JP) ..... 2004-188891

(51) Int. Cl.
*G03G 9/113* (2006.01)

(52) U.S. Cl. ..... 430/111.35

(58) Field of Classification Search ..... 430/111.35
See application file for complete search history.

(56) References Cited

U.S. PATENT DOCUMENTS

| | | | | |
|---|---|---|---|---|
| 4,020,192 | A * | 4/1977 | Nozaki | 430/111.1 |
| 2003/0091922 | A1* | 5/2003 | Okado et al. | 430/111.33 |
| 2004/0191661 | A1 | 9/2004 | Ohno et al. | 430/108.24 |
| 2006/0194071 | A1* | 8/2006 | Yano et al. | 428/480 |

FOREIGN PATENT DOCUMENTS

| | | |
|---|---|---|
| GB | 0932620 | 7/1963 |
| JP | 62-121462 | 6/1987 |
| JP | 2002-341600 | * 11/2002 |
| JP | 2002-351147 | 12/2002 |

OTHER PUBLICATIONS

Boudevska et al.; "The Influence of Molecular Interaction on Polymerization, 10[a)] On the Copolymerization of Methacrylic Acid with Styrene"; Makromol Chem. vol. 186, pp. 1711-1720 (1985).

Mulvaney et al.; "Water-Soluble Copolymers Containing *N*-Vinylcarbazole"; J. Polym. Sci., vol. 15, pp. 585-591 (1997).

Padmapriya et al.; "A New Method for the Esterfication of Sulphonic Acids"; Synthetic Communications, vol. 15, No. 12, pp. 1057-1062 (1985).

Toppet et al.; "Influence of the Reaction Medium on the Composition and the Microstructure of Styrene-Acrylic Acid Copolymers"; J. Polym. Sci., vol. 13, pp. 1879-1887 (1975).

* cited by examiner

*Primary Examiner*—Christopher RoDee
*Assistant Examiner*—Peter L Vajda
(74) *Attorney, Agent, or Firm*—Fitzpatrick, Cella, Harper & Scinto

(57) ABSTRACT

There is provided a resin-coated carrier with a coating layer attached to the surface of a core material in a stable manner, the electrophotographic carrier which can provide an image with excellent quality. The resin-coated carrier of the present invention comprises a resin-coating layer comprising, on a core material, a polymer comprising a unit represented by the formula (1):

(1)

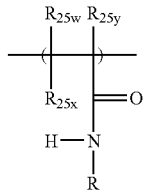

8 Claims, No Drawings

CARRIER FOR ELECTROPHOTOGRAPHIC DEVELOPER

BACKGROUND OF THE INVENTION

1. Field of the Invention

The present invention relates to a resin-coated carrier for an electrophotographic developer which constitutes a two-component developer used for development of an electrostatic latent image such as electrophotography, electrostatic recording or electrostatic printing, and to a two-component developer and a developer for replenishment using the same.

2. Related Background Art

Polymers having a hydrophilic group such as a sulfonic acid group are expected to be used for various applications.

The polymers containing a sulfonic acid group are generally synthesized only by using a specific vinyl monomer containing a sulfonic acid functional group. Specific examples of the monomer include sulfonated styrene and AMPS (2-acrylamido-2-methylpropanesulfonic acid). Such monomers are described in Japanese Patent Application Laid-Open No. 2002-351147.

Electrostatic printing comprising forming an electric latent image on the surface of a photoconductive material by electrostatic means and developing the latent image to form an image has been conventionally known, and various methods thereof are known. Specifically, electrostatic printing generally involves forming an electric latent image on a photosensitive member by various means using a photoconductive substance; then attaching a highly pulverized electroscopic material called toner, which is carried and transported by a developer carrying member, to the latent image to form a toner image corresponding to an electrostatic latent image; transferring the toner image to the surface of an image supporting member such as paper as required; and subsequently fixing the toner image with heat, pressure or solvent vapor to obtain a copy.

As a development method for visualizing an electric latent image with a toner, a powder cloud method, a cascade development method, a magnetic brush method, a method employing a conductive magnetic toner, etc. are known. In addition to the above methods, a so-called J/B development method comprising applying a bias electric field composed of an alternating current component and a direct current component to a space between a developer carrying member (development sleeve) and a photoconductive layer to carry out development is known. A typical example of the development method is a magnetic brush method. The magnetic brush method involves use of a two-component developer composed of a toner and a magnetic carrier. By using magnetic particles of steel, ferrite, etc. as a carrier, a developer comprising the magnetic carrier is retained on a developer carrying member having a magnet incorporated therein, and the developer is arranged in the shape of a brush on the developer carrying member by the action of the magnetic field of the magnet. When the magnetic brush is brought into contact with the electrostatic latent image surface on a photoconductive layer, only the toner in the developer is attracted from the brush to the electrostatic latent image, so that the electrostatic latent image is developed.

Carriers which constitute a two-component developer applied to the above development method are roughly classified into conductive carriers and insulating carriers. As a conductive carrier, an oxidized or non-oxidized iron powder is usually used. However, a developer having the iron powder carrier as a constituent triboelectrically charges a toner in an unstable manner. On the other hand, a typical insulating carrier is a resin-coated carrier comprising a carrier core material composed of a ferromagnetic material such as iron, nickel or ferrite having a surface uniformly coated with an insulating resin, generally. A developer with such an insulating resin-coated carrier very rarely causes adhesion of toner particles to the carrier surface as compared with the case of the conductive carrier as described above, exhibits easily controlled triboelectric charging between a toner and a carrier, and has excellent durability and a long useful life, advantageously, and is thus particularly suitable for a high-speed electronic copier.

Various properties are required for an insulating carrier. Particularly important properties include appropriate chargeability, impact resistance, abrasion resistance, good adhesion of a coating material to a core, and a uniform charge distribution. There has been proposed use of a resin with a small surface energy as a material for a coating layer to prevent spending of a carrier such as toner deposition, thereby improving durability of a developer. Specifically, it is said that a carrier coated with a silicone resin, a fluorine resin or the like is spent only with difficulty, and provides a developer with a long life. Japanese Patent Application Laid-Open No. S62-121462 discloses that a resin layer is improved by adding various silane coupling agents to a condensation reaction-type silicone resin.

Other problems in an electrophotographic carrier relate to endurance stability and environmental stability. Generally, problems with endurance stability include slow initial rising of the charge quantity, production of fog in the initial image, and a tendency toward an increased image density. Problems with endurance stability in the long-term copying include a reduced charge quantity, production of fog in the image and a tendency toward an increased image density. Generally, problems with environmental stability in a high humidity environment include a tendency toward a reduced charge quantity, production of fog in the image, an increase in the image density, and a tendency toward scattering of a toner. Problems with environmental stability in a low humidity environment include a tendency toward an increased charge quantity and a tendency toward a reduced image density.

SUMMARY OF THE INVENTION

An object of the present invention is to provide an electrophotographic carrier in which the above problems of the prior art are solved. Specifically, the present invention provides a resin-coated carrier with a coating layer attached to the surface of a core material in a stable manner, the electrophotographic carrier which has sufficient charging properties, excellent environmental stability and sufficient durability, and can provide an image with excellent quality which causes image smearing or the like only with difficulty.

The resin-coated carrier for electrophotographic development of the present invention is a resin-coated carrier for an electrophotographic developer which comprises a resin-coating layer comprising, on a core material, a polymer comprising a unit represented by the formula (1):

(1)

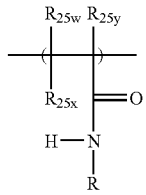

wherein R represents $-A_{25}-SO_2R_{25}$, $R_{25w}$, $R_{25x}$ and $R_{25y}$ form a combination selected from the group consisting of combinations described in (i) or (ii) below, and $A_{25}$ and $R_{25}$ form a combination selected from the group consisting of combinations described in (i-A) or (i-B) below in the case of (i), or $A_{25}$ and $R_{25}$ form a combination selected from the group consisting of combinations described in (ii-A) in the case of (ii), the combinations wherein (i) $R_{25w}$ and $R_{25x}$ are a hydrogen atom, and $R_{25y}$ is a $CH_3$ group or a hydrogen atom;

(i-A) $A_{25}$ is a substituted or unsubstituted aliphatic hydrocarbon structure, $R_{25}$ is a halogen atom or $OR_{25a}$, and $R_{25a}$ is a substituted or unsubstituted aliphatic hydrocarbon structure, a substituted or unsubstituted aromatic ring structure, or a substituted or unsubstituted heterocyclic structure;

(i-B) $A_{25}$ is a substituted or unsubstituted aromatic ring structure, or a substituted or unsubstituted heterocyclic structure, $R_{25}$ is OH, a halogen atom, ONa, OK or $OR_{25a}$, and $R_{25a}$ is a substituted or unsubstituted aliphatic hydrocarbon structure, a substituted or unsubstituted aromatic ring structure, or a substituted or unsubstituted heterocyclic structure;

(ii) $R_{25w}$ and $R_{25x}$ are independently a halogen atom or a hydrogen atom, $R_{25y}$ is a $CH_3$ group, a halogen atom or a hydrogen atom, and at least one of $R_{25w}$, $R_{25x}$ and $R_{25y}$ are a halogen atom; or (ii-A) $A_{25}$ is any of a substituted or unsubstituted aliphatic hydrocarbon structure, a substituted or unsubstituted aromatic ring structure, or a substituted or unsubstituted heterocyclic structure, $R_{25}$ is OH, a halogen atom, ONa, OK or $OR_{25a}$, and $R_{25a}$ is any of a substituted or unsubstituted aliphatic hydrocarbon structure, a substituted or unsubstituted aromatic ring structure, or a substituted or unsubstituted heterocyclic structure.

The two-component developer of the present invention is a two-component developer which comprises a resin-coated carrier and a toner comprising at least a binder resin and a colorant, wherein the resin-coated carrier is the above-described resin-coated carrier. Further, the developer for replenishment of the present invention is a developer for replenishment which comprises 1 part by weight of a carrier and 2 to 50 parts by weight of a toner based on the carrier, wherein the carrier is the above-described resin-coated carrier.

According to the present invention, there is provided an electrophotographic carrier in which a resin-coating layer is attached to a carrier core material in a stable manner and which has sufficient charging properties for a toner and excellent environmental stability.

DESCRIPTION OF THE PREFERRED EMBODIMENTS

The present invention will now be described in detail with reference to preferred embodiments. As a result of extensive studies on the above-described problems of the prior art, the present inventors have found that a toner can be provided with excellent durability and can be sufficiently charged irrespective of the environment, and an image with excellent quality can be obtained with a low possibility of image smearing which tends to notably occur in a high humidity environment usually, by a resin-coated carrier with the surface of a carrier core material coated with a resin, the resin which comprises at least a polymer comprising a unit represented by the formula (1):

(1)

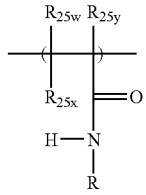

wherein R represents $-A_{25}-SO_2R_{25}$, $R_{25w}$, $R_{25x}$ and $R_{25y}$ form a combination selected from the group consisting of combinations described in (i) or (ii) below, and $A_{25}$ and $R_{25}$ form a combination selected from the group consisting of combinations described in (i-A) or (i-B) below in the case of (i), or $A_{25}$ and $R_{25}$ form a combination selected from the group consisting of combinations described in (ii-A) in the case of (ii), the combinations wherein (i) $R_{25w}$ and $R_{25x}$ are a hydrogen atom, and $R_{25y}$ is a $CH_3$ group or a hydrogen atom;

(i-A) $A_{25}$ is a substituted or unsubstituted aliphatic hydrocarbon structure, $R_{25}$ is a halogen atom or $OR_{25a}$, and $R_{25a}$ is a substituted or unsubstituted aliphatic hydrocarbon structure, a substituted or unsubstituted aromatic ring structure, or a substituted or unsubstituted heterocyclic structure;

(i-B) $A_{25}$ is a substituted or unsubstituted aromatic ring structure, or a substituted or unsubstituted heterocyclic structure, $R_{25}$ is OH, a halogen atom, ONa, OK or $OR_{25a}$, and $R_{25a}$ is a substituted or unsubstituted aliphatic hydrocarbon structure, a substituted or unsubstituted aromatic ring structure, or a substituted or unsubstituted heterocyclic structure;

(ii) $R_{25w}$ and $R_{25x}$ are independently a halogen atom or a hydrogen atom, $R_{25y}$ is a $CH_3$ group, a halogen atom or a hydrogen atom, and at least one of $R_{25w}$, $R_{25x}$ and $R_{25y}$ are a halogen atom; or (ii-A) $A_{25}$ is any of a substituted or unsubstituted aliphatic hydrocarbon structure, a substituted or unsubstituted aromatic ring structure, or a substituted or unsubstituted heterocyclic structure, $R_{25}$ is OH, a halogen atom, ONa, OK or $OR_{25a}$, and $R_{25a}$ is any of a substituted or unsubstituted aliphatic hydrocarbon structure, a substituted or unsubstituted aromatic ring structure, or a substituted or unsubstituted heterocyclic structure. This finding has led to the accomplishment of the present invention.

Given as a preferable unit of the formula (1) is a unit represented by the following formula (2):

(2)

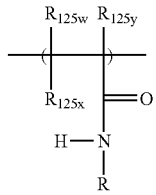

wherein R represents $-A_{125}-SO_2R_{125}$, $R_{125w}$, $R_{125x}$ and $R_{125y}$ form a combination selected from the group consisting of combinations described in (i) or (ii) below, and $A_{125}$ and $R_{125}$ form a combination selected from the group consisting of combinations described in (i-A) in the case of (i), or $A_{125}$ and $R_{125}$ form a combination selected from the group consisting of combinations described in (ii-A) in the case of (ii), the combinations wherein (i) $R_{125w}$ and $R_{125x}$ are a hydrogen atom, and $R_{125y}$ is a $CH_3$ group or a hydrogen atom;

(i-A) $A_{125}$ is a linear or branched alkylene group having 1 to 8 carbon atoms, $R_{125}$ is a halogen atom or $OR_{125a}$, and $R_{125a}$ is a linear or branched alkyl group having 1 to 8 carbon atoms, or a substituted or unsubstituted phenyl group;

(ii) $R_{125w}$ and $R_{125x}$ are independently a halogen atom or a hydrogen atom, $R_{125y}$ is a $CH_3$ group, a halogen atom or a hydrogen atom, and at least one of $R_{125w}$, $R_{125x}$ and $R_{125y}$ are a halogen atom; or (ii-A) $A_{125}$ is a linear or branched alkylene group having 1 to 8 carbon atoms, $R_{125}$ is OH, a halogen atom, ONa, OK or $OR_{125a}$, and $R_{125a}$ is a linear or branched alkyl group having 1 to 8 carbon atoms, or a substituted or unsubstituted phenyl group.

Further, given as a preferable unit of the formula (1) is a unit represented by the following formula (3):

(3)

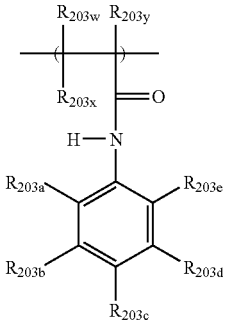

wherein $R_{203w}$ and $R_{203x}$ are independently a halogen atom or a hydrogen atom, $R_{203y}$ is a $CH_3$ group, a halogen atom or a hydrogen atom, at least one of $R_{203a}$, $R_{203b}$, $R_{203c}$, $R_{203d}$ and $R_{203e}$ is $SO_2R_{203f}$, wherein $R_{203f}$ is OH, a halogen atom, ONa, OK or $OR_{203h}$, and $R_{203h}$ represents a linear or branched alkyl group having 1 to 8 carbon atoms, or a substituted or unsubstituted phenyl group, and the others of $R_{203a}$, $R_{203b}$, $R_{203c}$, $R_{203d}$ and $R_{203e}$ are selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{203g}$, wherein $R_{203g}$ represents any of an H atom, a Na atom and a K atom, an acetoamide group, an OPh group, an NHPh group, a $CF_3$ group, a $C_2F_5$ group and a $C_3F_7$ group.

Further, in a preferred embodiment of the present invention, the unit represented by the formula (1) is any of a unit represented by the formula (4a):

(4a)

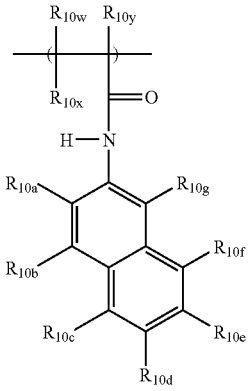

wherein $R_{10w}$ and $R_{10x}$ are independently a halogen atom or a hydrogen atom, $R_{10y}$ is a $CH_3$ group, a halogen atom or a hydrogen atom, at least one of $R_{10a}$, $R_{10b}$, $R_{10c}$, $R_{10d}$, $R_{10e}$, $R_{10f}$ of and $R_{10g}$ is $SO_2R_{10o}$, wherein $R_{10o}$ is OH, a halogen atom, ONa, OK or $OR_{10s}$, and $R_{10s}$ represents a linear or branched alkyl group having 1 to 8 carbon atoms, or a substituted or unsubstituted phenyl group, and the others of $R_{10a}$, $R_{10b}$, $R_{10c}$, $R_{10d}$, $R_{10e}$, $R_{10f}$ and $R_{10g}$ are selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{10p}$, wherein $R_{10p}$ represents any of an H atom, a Na atom and a K atom, an acetoamide group, an OPh group, an NHPh group, a $CF_3$ group, a $C_2F_5$ group and a $C_3F_7$ group, and a unit represented by the formula (4b):

(4b)

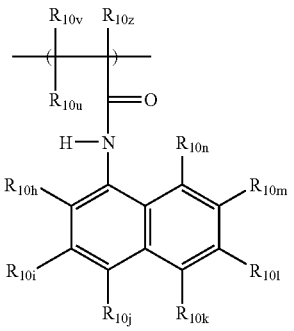

wherein $R_{10v}$ and $R_{10u}$ are independently a halogen atom or a hydrogen atom, $R_{10z}$ is a $CH_3$ group, a halogen atom or a hydrogen atom, at least one of $R_{10h}$, $R_{10i}$, $R_{10j}$, $R_{10k}$, $R_{10l}$, $R_{10m}$ and $R_{10n}$ is $SO_2R_{10q}$, wherein $R_{10q}$ is OH, a halogen atom, ONa, OK or $OR_{10t}$, and $R_{10t}$ represents a linear or branched alkyl group having 1 to 8 carbon atoms, or a substituted or unsubstituted phenyl group, and the others of $R_{10h}$, $R_{10i}$, $R_{10j}$, $R_{10k}$, $R_{10l}$, $R_{10m}$ and $R_{10n}$ are selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{10r}$, wherein $R_{10p}$ represents any of an H atom, a Na atom and a K atom, an acetoamide group, an OPh group, an NHPh group, a $CF_3$ group, a $C_2F_5$ group and a $C_3F_7$ group.

The above polymer may comprise, in addition to the unit represented by the formula (1), at least any one unit derived from a vinyl monomer which is represented by the formula (5):

(5)

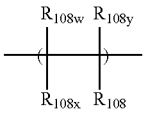

wherein $R_{108w}$ and $R_{108x}$ are independently a halogen atom or a hydrogen atom, $R_{108y}$ is a $CH_3$ group, a halogen atom or a hydrogen atom, $R_{108}$ is any of a hydrogen atom, a substituted or unsubstituted aliphatic hydrocarbon structure, a substituted or unsubstituted aromatic ring structure, a substituted or unsubstituted heterocyclic structure, a halogen atom, —$COR_{108a}$, —$OR_{108b}$, —$COOR_{108c}$, —$OCOR_{108d}$, —$CONR_{108e}R_{108f}$, —CN and a cyclic structure containing an N atom, and $R_{108a}$, $R_{108b}$, $R_{108c}$, $R_{108d}$, $R_{108e}$ and $R_{108f}$ are independently any of a hydrogen atom, a substituted or unsubstituted aliphatic hydrocarbon structure, a substituted or unsubstituted aromatic ring structure, or a substituted or unsubstituted heterocyclic structure.

(Method (A) for Producing Polymer Represented by Formula (1))

For example, the polymer comprising a unit represented by the formula (1) can be produced by reacting a unit used as a starting material which is represented by the formula (6):

(6)

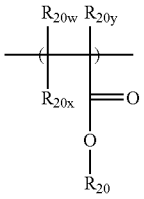

wherein $R_{20w}$ and $R_{20x}$ are independently a halogen atom or a hydrogen atom, $R_{20y}$ is a $CH_3$ group, a halogen atom or a hydrogen atom, $R_{20}$ is an H atom, a Na atom or a K atom, and, when there are a plurality of such units, $R_{20}$, $R_{20w}$, $R_{20x}$ and $R_{20y}$ represent the same as described above for each unit, with at least one compound represented by the formula (7):

$$H_2N\text{-}A_{21}SO_2R_{21} \quad (7)$$

wherein $R_{21}$ is OH, a halogen atom, ONa, OK or $OR_{21a}$, and $A_{21}$ and $R_{21a}$ independently represent a substituted or unsubstituted aliphatic hydrocarbon structure, a substituted or unsubstituted aromatic ring structure, or a substituted or unsubstituted heterocyclic structure.

(Method for Producing Polymer Comprising Unit Represented by Formula (6))

The polymer having a carboxyl group represented by the formula (6) can be easily produced using a known polymerization method and polymer reaction, as a copolymer comprising a unit represented by the formula (6):

(6)

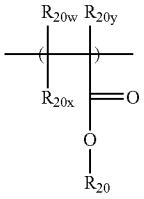

wherein $R_{20w}$ and $R_{20x}$ are independently a halogen atom or a hydrogen atom, $R_{20y}$ is a $CH_3$ group, a halogen atom or a hydrogen atom, $R_{20}$ is an H atom, a Na arom or a K atom, and, when there are a plurality of such units, $R_{20}$, $R_{20w}$, $R_{20x}$ and $R_{20y}$ represent the same as described above for each unit, and a vinyl monomer unit represented by the formula (5):

(5)

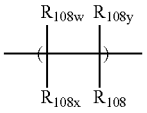

wherein $R_{108w}$ and $R_{108x}$ are independently a halogen atom or a hydrogen atom, $R_{108y}$ is a $CH_3$ group, a halogen atom or a hydrogen atom, $R_{108}$ is any of a hydrogen atom, a substituted or unsubstituted aliphatic hydrocarbon structure, a substituted or unsubstituted aromatic ring structure, a substituted or unsubstituted heterocyclic structure, a halogen atom, —$COR_{108a}$, —$OR_{108b}$, —$COOR_{108c}$, —$OCOR_{108d}$, —$CONR_{108e}R_{108f}$, —CN and a cyclic structure containing an N atom, and $R_{108a}$, $R_{108b}$, $R_{108c}$, $R_{108d}$, $R_{108e}$ and $R_{108f}$ are independently any of a hydrogen atom, a substituted or unsubstituted aliphatic hydrocarbon structure, a substituted or unsubstituted aromatic ring structure, or a substituted or unsubstituted heterocyclic structure.

Examples of the vinyl monomer for introducing the unit represented by the formula (5) include styrene and its derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; unsaturated monoolefins such as ethylene, propylene, butylene and isobutylene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and vinyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. One or more of these may be selected for use as required.

A methacrylic acid ester/methacrylic acid copolymer or an acrylic acid ester/acrylic acid copolymer which has a carboxylic group as an example of the polymer comprising a unit having a carboxylic group represented by the formula (6) can be obtained by partially hydrolyzing a homopolymer of a methacrylic acid ester or acrylic acid ester.

Further, the copolymer having a carboxylic group can be easily obtained by synthesizing a copolymer of other polymerizable monomers with an acrylic acid ester or methacrylic acid ester and carrying out de-esterification in the same manner as above.

In addition, the copolymer having a carboxylic group can also be obtained by directly polymerizing acrylic acid or methacrylic acid with other polymerizable monomers.

(Compound Represented by Formula (7))

Given as the compound represented by the formula (7) used in the present invention is a compound represented by the formula (7):

$$H_2N\text{-}A_{21}\text{-}SO_2R_{21} \quad (7)$$

wherein $R_{21}$ is OH, a halogen atom, ONa, OK or $OR_{21a}$, and $A_{21}$ and $R_{21a}$ independently represent a substituted or unsubstituted aliphatic hydrocarbon structure, a substituted or unsubstituted aromatic ring structure, or a substituted or unsubstituted heterocyclic structure. More particularly, $A_2$, represents a linear or branched alkylene group having 1 to 8 carbon atoms, a substituted or unsubstituted phenyl group, a substituted or unsubstituted naphthyl group or a substituted or unsubstituted heterocyclic structure containing one or more of N atom, S atom and O atom. When $A_{21}$ is a cyclic structure, the ring may be further condensed if unsubstituted.

Examples of the compound of the formula (7), wherein $A_{21}$ is a linear or branched alkylene group having 1 to 8 carbon atoms, include 2-aminoethanesulfonic acid (taurine), 3-aminopropanesulfonic acid, 4-aminobutanesulfonic acid and 2-amino-2-methylpropanesulfonic acid, and their alkali metal salts.

The compound of the formula (7), wherein $A_{21}$ is a substituted or unsubstituted phenyl group, is represented by the formula (8):

(8)

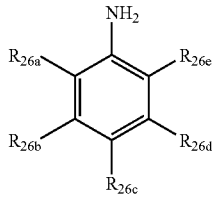

wherein at least one of $R_{26a}$, $R_{26b}$, $R_{26c}$, $R_{26d}$ and $R_{26e}$ is $SO_2R_{26f}$, wherein $R_{26f}$ is OH, a halogen atom, ONa, OK or $OR_{26h}$, and $R_{26h}$ represents a substituted or unsubstituted aliphatic hydrocarbon structure, a substituted or unsubstituted aromatic ring structure, or a substituted or unsubstituted heterocyclic structure, and the others of $R_{26a}$, $R_{26b}$, $R_{26c}$, $R_{26d}$ and $R_{26e}$ are independently selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{26g}$, wherein $R_{26g}$ represents any of an H atom, a Na atom and a K atom, an acetoamide group, an OPh group, an NHPh group, a $CF_3$ group, a $C_2F_5$ group and a $C_3F_7$ group.

Examples of the compound represented by the formula (8) include various aminobenzenesulfonic acid derivatives and their salts such as p-aminobenzenesulfonic acid (sulfanilic acid), m-aminobenzenesulfonic acid, o-aminobenzenesulfonic acid, m-toluidine-4-sulfonic acid, o-toluidine-4-sulfonic acid sodium salt, p-toluidine-2-sulfonic acid, 4-methoxyaniline-2-sulfonic acid, o-anisidine-5-sulfonic acid, p-anisidine-3-sulfonic acid, 3-nitroaniline-4-sulfonic acid, 2-nitroaniline-4-sulfonic acid sodium salt, 4-nitroaniline-2-sulfonic acid sodium salt, 1,5-dinitroaniline-4-sulfonic acid, 2-aminophenol-4-hydroxy-5-nitrobenzenesulfonic acid, 2,4-dimethylaniline-5-sulfonic acid sodium salt, 2,4-dimethylaniline-6-sulfonic acid, 3,4-dimethylaniline-5-sulfonic acid, 4-isopropylaniline-6-sulfonic acid, 4-trifluoromethylaniline-6-sulfonic acid, 3-carboxy-4-hydroxyaniline-5-sulfonic acid and 4-carboxyaniline-6-sulfonic acid; and esters including methyl esters or phenyl esters of various aminobenzenesulfonic acid derivatives and their salts, such as 2-aminobenzenesulfonic acid methyl ester, 4-aminobenzenesulfonic acid methyl ester, 2-aminobenzenesulfonic acid phenyl ester and 4-aminobenzenesulfonic acid phenyl ester.

One or more of these may be selected for use as required.

The compound of the formula (7), wherein $A_{21}$ is a substituted or unsubstituted naphthyl group, is represented by the formula (9a):

(9a)

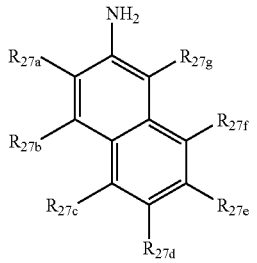

wherein at least one of $R_{27a}$, $R_{27b}$, $R_{27c}$, $R_{27d}$, $R_{27e}$, $R_{27f}$ and $R_{27g}$ is $SO_2R_{27o}$, wherein $R_{27o}$ is OH, a halogen atom, ONa, OK or $OR_{27s}$, and $R_{27s}$ is a substituted or unsubstituted aliphatic hydrocarbon structure, a substituted or unsubstituted aromatic ring structure, or a substituted or unsubstituted heterocyclic structure, and the others of $R_{27a}$, $R_{27b}$, $R_{27c}$, $R_{27d}$, $R_{27e}$, $R_{27f}$ and $R_{27g}$ are independently selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{27p}$, wherein $R_{27p}$ represents any of an H atom, a Na atom and a K atom, an acetoamide group, an OPh group, an NHPh group, a $CF_3$ group, a $C_2F_5$ group and a $C_3F_7$ group, or represented by the formula (9b):

(9b)

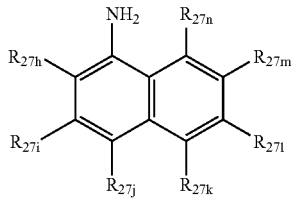

wherein at least one of $R_{27h}$, $R_{27i}$, $R_{27j}$, $R_{27k}$, $R_{27l}$, $R_{27m}$ and $R_{27n}$ is $SO_2R_{27q}$, wherein $R_{27q}$ is OH, a halogen atom, ONa, OK or $OR_{27t}$, and $R_{27t}$ is a substituted or unsubstituted aliphatic hydrocarbon structure, a substituted or unsubstituted aromatic ring structure, or a substituted or unsubstituted heterocyclic structure, and the others of $R_{27h}$, $R_{27i}$, $R_{27j}$, $R_{27k}$, $R_{27l}$, $R_{27m}$ and $R_{27n}$ are independently selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{27r}$, wherein $R_{27r}$ represents any of an H atom, a Na atom and a K atom, an acetoamide group, an OPh group, an NHPh group, a $CF_3$ group, a $C_2F_5$ group and a $C_3F_7$ group.

Examples of the compound represented by the formula (9a) or (9b) include various naphthylaminesulfonic acid derivatives and their salts such as 1-naphthylamine-4-sulfonic acid, 1-naphthylamine-5-sulfonic acid, 1-naphthylamine-6-sulfonic acid, 1-naphthylamine-7-sulfonic acid, 1-naphthylamine-8-sulfonic acid, 2-naphthylamine-1-sulfonic acid, 2-naphthylamine-5-sulfonic acid, 1-naphthylamine-2-ethoxy-6-sulfonic acid, 1-amino-2-naphthol-4-sulfonic acid, 6-amino-1-naphthol-3-sulfonic acid, 1-amino-8-naphthol-2,4-sulfonic acid monosodium salt and 1-amino-8-naphthol-3,6-sulfonic acid monosodium salt; and esters including methyl esters or phenyl esters of various naphthylaminesulfonic acid derivatives and their salts, such as 1-naphthylamine-8-sulfonic acid methyl ester, 2-naphthylamine-1-sulfonic acid methyl ester, 1-naphthylamine-8-sulfonic acid phenyl ester and 2-naphthylamine-1-sulfonic acid phenyl ester. One or more of these may be selected for use as required.

Examples of the compound represented by the formula (7), wherein $A_{21}$ is a substituted or unsubstituted heterocyclic structure containing one or more of N atom, S atom and O atom, include a pyridine ring, a piperazine ring, a furan ring and a thiol ring. One or more of these may be selected for use as required.

The condensation reaction of the polymer comprising a unit represented by the formula (6) with the aminosulfonic acid compound represented by the formula (7) in the present invention will be described in detail. For the condensation reaction of a carboxyl group with an amino group, any methods such as a method using a condensing agent, a method for carrying out condensation by dehydration reaction forming a salt, a method using a dehydrating agent, and a method comprising converting a carboxyl group into an acid chloride and reacting an amino group therewith can be employed.

First, the method using a condensing agent will be described in detail.

As the condensing agent, a phosphoric acid condensing agent, a carbodiimide condensing agent, an acid chloride condensing agent or the like can be used. Examples of the phosphoric acid condensing agent that can be used include a phosphorous acid ester condensing agent, a phosphorus chloride condensing agent, a phosphoric acid anhydride condensing agent, a phosphoric acid ester condensing agent, a phosphoric acid amide condensing agent and a thionyl chloride condensing agent. In the reaction of the present invention, a phosphorous acid ester condensing agent is preferably used. Examples of the phosphorous acid ester used herein include triphenyl phosphite, trimethyl phosphite, triethyl phosphite, diphenyl phosphite, tri-o-tolyl phosphite, di-o-tolyl phosphite, tri-m-tolyl phosphite, di-m-tolyl phosphite, tri-p-tolyl phosphite, di-p-tolyl phosphite, di-o-chlorophenyl phosphite, tri-p-chlorophenyl phosphite and di-p-chlorophenyl phosphate. Of these, triphenyl phosphate is preferably used. The condensing agent is used in an amount of 0.1 mol or more, and more preferably 1 mol or more per mol of the compound represented by the formula (7). Further, the condensing agent itself can be used as a reaction solvent.

The compound represented by the formula (7) is used in this method in an amount of 0.1 to 50.0 mol, and preferably 1.0 to 20.0 mol per mol of the unit represented by the formula (6) used as a starting material.

In the reaction of the present invention, a solvent may be used where necessary. Examples of the solvent used include hydrocarbons such as hexane, cyclohexane and heptane; ketones such as acetone and methyl ethyl ketone; ethers such as dimethyl ether, diethyl ether and tetrahydrofuran; halogenated hydrocarbons such as dichloromethane, chloroform, carbon tetrachloride, dichloroethane and trichloroethane; aromatic hydrocarbons such as benzene and toluene; aprotic polar solvents such as N,N-dimethylformamide and dimethyl sulfoxide; and a pyridine derivative. Pyridine is particularly preferably used. The amount of the solvent used can be appropriately selected according to the type of the starting material or the base, the reaction conditions, etc.

In this method, the reaction temperature is not specifically limited, but usually in the range of 0° C. to the boiling point of the solvent. However, the reaction preferably takes place at an appropriate temperature according to the condensing agent used. In the method of the present invention, the reaction time cannot be specifically defined, but is usually 1 to 48 hours. The solvent can be removed by distillation as a conventional technique from the reaction solution containing the polymer represented by the formula (1) produced in this manner. Alternatively, the target polymer represented by the formula (1) can be collected by mixing the reaction solution with a homogeneous solvent in which the polymer represented by the formula (1) is insoluble, such as water, an alcohol such as methanol or ethanol, or an ether such as dimethyl ether, diethyl ether or tetrahydrofuran, to reprecipitate the polymer. The polymer represented by the formula (1) thus obtained can be isolated and purified if necessary. There are no specific limitations to the isolation and purification method. A method of reprecipitating the polymer represented by the formula (1) using a solvent in which the polymer is insoluble, or a method using column chromatography can be used.

(Method (B) for Producing Polymer Represented by Formula (1))

The polymer comprising one or more units represented by the formula (1) in the molecule can be synthesized by polymerizing a compound represented by the formula (901) alone or with other polymerizable monomers.

(Method for Producing Compound Represented by Formula (901))

The compound represented by the formula (901):

(901)

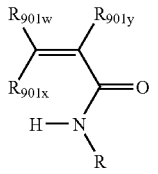

wherein R represents $-A_{901}-SO_2R_{901}$, $R_{901w}$, $R_{901x}$ and $R_{901y}$ form a combination selected from the group consisting of combinations described in (i) or (ii) below, and $A_{901}$ and $R_{901}$ form a combination selected from the group consisting of combinations described in (i-A) or (i-B) below in the case of (i), or $A_{901}$ and $R_{901}$ form a combination selected from the group consisting of combinations described in (ii-A) in the case of (ii), the combinations wherein (i) $R_{901w}$ and $R_{901x}$ are a hydrogen atom, and $R_{901y}$ is a $CH_3$ group or a hydrogen atom;

(i-A) $A_{901}$ is a substituted or unsubstituted aliphatic hydrocarbon structure;

$R_{901}$ is OH, a halogen atom, ONa, OK or $OR_{901a}$, and $R_{901a}$ is a substituted or unsubstituted aliphatic hydrocarbon structure, a substituted or unsubstituted aromatic ring structure, or a substituted or unsubstituted heterocyclic structure;

(i-B) $A_{901}$ is a substituted or unsubstituted aromatic ring structure, or a substituted or unsubstituted heterocyclic structure, $R_{901}$ is OH, a halogen atom, ONa, OK or $OR_{901a}$, and $R_{901a}$ is a substituted or unsubstituted aliphatic hydrocarbon structure, a substituted or unsubstituted aromatic ring structure, or a substituted or unsubstituted heterocyclic structure;

(ii) $R_{901w}$ and $R_{901x}$ are independently a halogen atom or a hydrogen atom, $R_{901y}$ is a $CH_3$ group, a halogen atom or a hydrogen atom, and at least one of $R_{901w}$, $R_{901x}$ and $R_{901y}$ are a halogen atom; or (ii-A) $A_{901}$ is any of a substituted or unsubstituted aliphatic hydrocarbon structure, a substituted or unsubstituted aromatic ring structure, or a substituted or unsubstituted heterocyclic structure, $R_{901}$ is OH, a halogen atom, ONa, OK or $OR_{901a}$, and $R_{901a}$ is any of a substituted or unsubstituted aliphatic hydrocarbon structure, a substituted or unsubstituted aromatic ring structure, or a substituted or unsubstituted heterocyclic structure, can be produced by the following method.

The method for synthesizing the compound represented by the formula (901) in the present invention will be described in detail. The compound of the formula (901) is synthesized by condensation reaction of a polymerizable monomer having a carboxyl group such as methacrylic acid or acrylic acid, or an acid chloride-polymerizable monomer such as acrylic acid chloride or methacrylic acid chloride obtained by converting a carboxylic group into an acid chloride with various compounds having an amino group represented by the formula (817) described later.

For the condensation reaction of a carboxyl group with an amino group, any methods such as a method using a condensing agent, a method for carrying out condensation by dehydration reaction forming a salt, a method using a dehydrating agent, and a method comprising converting a carboxyl group into an acid chloride and reacting an amino group therewith can be employed.

As a production method of the present invention, a method comprising converting a carboxyl group into an acid chloride and reacting an amino group therewith will be described in detail.

The polymerizable monomer represented by the formula (717):

(717)

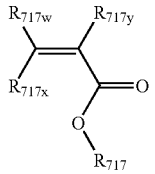

wherein $R_{717w}$ and $R_{717x}$ are independently a halogen atom or a hydrogen atom, $R_{717y}$ is a $CH_3$ group, a halogen atom or a hydrogen atom, $R_{717}$ is an H atom, a Na arom or a K atom, and, when there are a plurality of such units, $R_{717}$, $R_{717w}$, $R_{717x}$ and $R_{717y}$ represent the same as described above for each unit, can be converted into an acid chloride by use of thionyl chloride as a conventional technique.

Thionyl chloride is used in an amount of 0.1 to 50.0 mol, and preferably 1.0 to 20.0 mol per mol of the compound represented by the formula (717). Further, thionyl chloride itself can be used as a reaction solvent.

The compound represented by the formula (817) described later is used in this method in an amount of 0.1 to 50.0 mol, and preferably 1.0 to 20.0 mol per mol of the unit represented by the formula (717) used as a starting material. In the reaction of the present invention, a solvent may be used where necessary. Examples of the solvent used include hydrocarbons such as hexane, cyclohexane and heptane; ketones such as acetone and methyl ethyl ketone; ethers such as dimethyl ether, diethyl ether and tetrahydrofuran; halogenated hydrocarbons such as dichloromethane, chloroform, carbon tetrachloride, dichloroethane and trichloroethane; aromatic hydrocarbons such as benzene and toluene; aprotic polar solvents such as N,N-dimethylformamide and dimethyl sulfoxide; a pyridine derivative and water. The solvent is preferably a solvent in which the later-described compound represented by the formula (817) is soluble. The amount of the solvent used can be appropriately selected according to the starting material, the reaction conditions, etc.

In this method, the reaction temperature is not specifically limited, but usually in the range of −30° C. to the boiling point of the solvent. However, the reaction preferably takes place at an appropriate temperature according to the compound represented by the formula (817) described later and the reaction solvent to be used. In the method of the present invention, the reaction time cannot be specifically defined, but is usually 1 to 48 hours. The solvent can be removed by distillation as a conventional technique from the reaction solution containing the compound represented by the formula (901) produced in this manner.

The compound represented by the formula (901) thus obtained can be isolated and purified if necessary. There are no specific limitations to the isolation and purification method. A method of recrystallizing the compound represented by the formula (901) using a solvent in which the compound is poorly soluble, or a method using column chromatography can be used.

(Compound Represented by Formula (817))

Given as the compound represented by the formula (817) used in the present invention is a compound represented by the formula (817):

$$H_2N\text{-}A_{817}\text{-}SO_2R_{817} \quad (817)$$

wherein $R_{817}$ is OH, a halogen atom, ONa, OK or $OR_{817a}$, and $A_{817}$ and $R_{817a}$ independently represent a substituted or unsubstituted aliphatic hydrocarbon structure, a substituted or unsubstituted aromatic ring structure, or a substituted or unsubstituted heterocyclic structure.

More particularly, $A_{817}$ represents a linear or branched alkylene group having 1 to 8 carbon atoms, a substituted or unsubstituted phenyl group, a substituted or unsubstituted naphthyl group or a substituted or unsubstituted heterocyclic structure containing one or more of N atom, S atom and O atom. When $A_{817}$ is a cyclic structure, the ring may be further condensed if unsubstituted.

Examples of the compound of the formula (817), wherein $A_{817}$ is a linear or branched alkylene group having 1 to 8 carbon atoms, include 2-aminoethanesulfonic acid (taurine), 3-aminopropanesulfonic acid, 4-aminobutanesulfonic acid and 2-amino-2-methylpropanesulfonic acid, and their alkali metal salts.

The compound of the formula (817), wherein $A_{817}$ is a substituted or unsubstituted phenyl group, is represented by the formula (26):

(26)

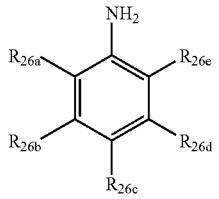

wherein at least one of $R_{26a}$, $R_{26b}$, $R_{26c}$, $R_{26d}$ and $R_{26e}$ is $SO_2R_{26f}$, wherein $R_{26f}$ is OH, a halogen atom, ONa, OK or $OR_{26h}$, and $R_{26h}$ is a substituted or unsubstituted aliphatic hydrocarbon structure, a substituted or unsubstituted aromatic ring structure, or a substituted or unsubstituted heterocyclic structure, and the others of $R_{26a}$, $R_{26b}$, $R_{26c}$, $R_{26d}$ and $R_{26e}$ are independently selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{26g}$, wherein $R_{26g}$ represents any of an H atom, a Na atom and a K atom, an acetoamide group, an OPh group, an NHPh group, a $CF_3$ group, a $C_2F_5$ group and a $C_3F_7$ group.

Examples of the compound represented by the formula (26) include various aminobenzenesulfonic acid derivatives and their salts such as p-aminobenzenesulfonic acid (sulfanilic acid), m-aminobenzenesulfonic acid, o-aminobenzenesulfonic acid, m-toluidine-4-sulfonic acid, o-toluidine-4-sulfonic acid sodium salt, p-toluidine-2-sulfonic acid, 4-methoxyaniline-2-sulfonic acid, o-anisidine-5-sulfonic acid, p-anisidine-3-sulfonic acid, 3-nitroaniline-4-sulfonic acid, 2-nitroaniline-4-sulfonic acid sodium salt, 4-nitroaniline-2-sulfonic acid sodium salt, 1,5-dinitroaniline-4-sulfonic acid, 2-aminophenol-4-hydroxy-5-nitrobenzenesulfonic acid, 2,4-dimethylaniline-5-sulfonic acid sodium salt, 2,4-dimethylaniline-6-sulfonic acid, 3,4-dimethylaniline-5-sulfonic acid, 4-isopropylaniline-6-sulfonic acid, 4-trifluoromethylaniline-6-sulfonic acid, 3-carboxy-4-hydroxyaniline-5-sulfonic acid and 4-carboxyaniline-6-sulfonic acid; and esters including methyl esters or phenyl esters of various aminobenzenesulfonic acid derivatives and their salts, such as 2-aminobenzenesulfonic acid methyl ester, 4-aminobenzenesulfonic acid methyl ester, 2-aminobenzenesulfonic acid phenyl ester and 4-aminobenzenesulfonic acid phenyl ester.

The compound of the formula (817), wherein $A_{817}$ is a substituted or unsubstituted naphthyl group, is represented by the formula (27a):

(27a)

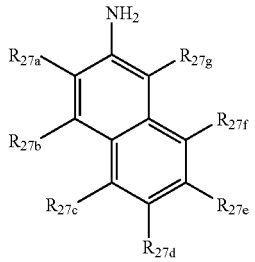

wherein at least one of $R_{27a}$, $R_{27b}$, $R_{27c}$, $R_{27d}$, $R_{27e}$, $R_{27f}$ and $R_{27g}$ is $SO_2R_{27o}$, wherein $R_{27o}$ is OH, a halogen atom, ONa, OK or $OR_{27s}$, and $R_{27s}$ is a substituted or unsubstituted aliphatic hydrocarbon structure, a substituted or unsubstituted aromatic ring structure, or a substituted or unsubstituted heterocyclic structure, and the others of $R_{27a}$, $R_{27b}$, $R_{27c}$, $R_{27d}$, $R_{27e}$, $R_{27f}$ and $R_{27g}$ are independently selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{27p}$, wherein $R_{27p}$ represents any of an H atom, a Na atom and a K atom, an acetoamide group, an OPh group, an NHPh group, a $CF_3$ group, a $C_2F_5$ group and a $C_3F_7$ group, or represented by the formula (27b):

(27b)

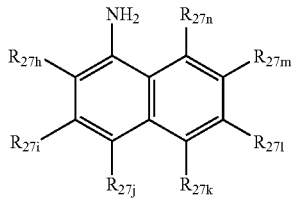

wherein at least one of $R_{27h}$, $R_{27i}$, $R_{27j}$, $R_{27k}$, $R_{27l}$, $R_{27m}$ and $R_{27n}$ is $SO_2R_{27q}$, wherein $R_{27q}$ is OH, a halogen atom, ONa, OK or $OR_{27t}$, and $R_{27t}$ is a substituted or unsubstituted aliphatic hydrocarbon structure, a substituted or unsubstituted aromatic ring structure, or a substituted or unsubstituted heterocyclic structure, and the others of $R_{27h}$, $R_{27i}$, $R_{27j}$, $R_{27k}$, $R_{27l}$, $R_{27m}$ and $R_{27n}$ are independently selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{27r}$, wherein $R_{27r}$ represents any of an H atom, a Na atom and a K atom, an acetoamide group, an OPh group, an NHPh group, a $CF_3$ group, a $C_2F_5$ group and a $C_3F_7$ group.

Examples of the compound represented by the formula (27a) or (27b) include various naphthylaminesulfonic acid derivatives and their salts such as 1-naphthylamine-4-sulfonic acid, 1-naphthylamine-5-sulfonic acid, 1-naphthylamine-6-sulfonic acid, 1-naphthylamine-7-sulfonic acid, 1-naphthylamine-8-sulfonic acid, 2-naphthylamine-1-sulfonic acid, 2-naphthylamine-5-sulfonic acid, 1-naphthylamine-2-ethoxy-6-sulfonic acid, 1-amino-2-naphthol-4-sulfonic acid, 6-amino-1-naphthol-3-sulfonic acid, 1-amino-8-naphthol-2,4-sulfonic acid monosodium salt and 1-amino-8-naphthol-3,6-sulfonic acid monosodium salt; and esters including methyl esters or phenyl esters of various naphthylaminesulfonic acid derivatives and their salts, such as 1-naphthylamine-8-sulfonic acid methyl ester, 2-naphthylamine-1-sulfonic acid methyl ester, 1-naphthylamine-8-sulfonic acid phenyl ester and 2-naphthylamine-1-sulfonic acid phenyl ester.

Examples of the compound represented by the formula (817), wherein $A_{817}$ is a substituted or unsubstituted heterocyclic structure containing one or more of N atom, S atom and O atom, include a pyridine ring, a piperazine ring, a furan ring and a thiol ring.

When using the compound represented by the formula (901) synthesized by the above method, not comprising a sulfonic acid ester unit, for example, such a compound wherein $R_{901}$ is OH, a halogen atom, ONa or OK, if an esterifying agent such as trimethylsilyldiazomethane, trimethyl orthoformate or triethyl orthoformate is used further, the compound represented by the formula (901) comprising a sulfonic acid ester unit, wherein $R_{901}$ represents $OR_{901a}$, can be synthesized.

In this reaction, a solvent may be used where necessary. Examples of the solvent used include hydrocarbons such as hexane, cyclohexane and heptane; alcohols such as methanol and ethanol; ethers such as dimethyl ether, diethyl ether, tetrahydrofuran and dioxane; halogenated hydrocarbons such as dichloromethane, chloroform, carbon tetrachloride, dichloroethane and trichloroethane; aromatic hydrocarbons such as benzene and toluene; aprotic polar solvents such as N,N-dimethylformamide and dimethyl sulfoxide; and a pyridine derivative. Chloroform and methanol are particularly preferably used. The amount of the solvent used can be appropriately selected according to the starting material, the reaction conditions, etc.

The esterifying agent is used in an amount of 0.1 to 50 mol, and more preferably 1 to 20 mol per mol of the unit represented by the formula (901), wherein $R_{901}$ is OH, a halogen atom, ONa or OK.

In this method, the reaction temperature is not specifically limited, but usually in the range of −20° C. to 30° C. The reaction time cannot be specifically defined, but is usually 1 to 48 hours.

The solvent can be removed by distillation as a conventional technique from the reaction solution containing the compound represented by the formula (901) comprising a sulfonic acid ester unit, wherein $R_{901}$ represents $OR_{901a}$, produced in this manner.

The compound represented by the formula (901) thus obtained which comprises a sulfonic acid ester unit, wherein $R_{901}$ represents $OR_{901a}$, can be isolated and purified if necessary. There are no specific limitations to the isolation and purification method. A method of recrystallizing the compound represented by the formula (901) comprising a sulfonic acid ester unit, wherein $R_{901}$ represents $OR_{901a}$, using a solvent in which the compound is poorly soluble, or a method using column chromatography can be used.

(Method for Polymerizing Compound Represented by Formula (901))

Various known polymerization reactions can be used as the method for polymerizing the compound represented by the formula (901). Copolymerization with various known monomers is also possible.

Examples of the copolymerizable monomer include styrene and its derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; unsaturated monoolefins such as ethylene, propylene, butylene and isobutylene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and vinyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

When polymerizing the compound of the formula (901) not comprising a sulfonic acid ester unit, for example, such a compound wherein $R_{901}$ is OH, a halogen atom, ONa or OK, radical polymerization of which the polymerization conditions are relatively easily controlled can be particularly preferably used. When the compound of the formula (901) has a sulfonic acid ester unit, ionic polymerization can also be used.

Examples of the initiator when using radical polymerization include t-butyl peroxy-2-ethylhexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutylonitrile, 2,2'-azobis(2-methylbutylonitrile), 2,2'-azobis(2,4-dimethylvaleronitrile), 2,2'-azobis(4-methoxy-2,4-dimethylvaleronitrile), 1,1-bis(t-butylperoxy)3,3,5-trimethylcyclohexane, 1,1-bis(t-butylperoxy)cyclohexane, 1,4-bis(t-butylperoxycarbonyl) cyclohexane, 2,2-bis(t-butylperoxy)octane, n-butyl 4,4-bis(t-butylperoxy)valerate, 2,2-bis(t-butylperoxy)butane, 1,3-bis (t-butylperoxy-isopropyl)benzene, 2,5-dimethyl-2,5-di(t-butylperoxy)hexane, 2,5-dimethyl-2,5-di(t-butylperoxy) hexane, 2,5-dimethyl-2,5-di(benzoylperoxy)hexane, di-t-butyl diperoxyisophthalate, 2,2-bis(4,4-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), di-t-butyl peroxytrimethyladipate, tris(t-butylperoxy)triazine and vinyltris (t-butylperoxy) silane. Water-soluble initiators such as potassium persulfate and ammonium persulfate can also be used.

These may be used singly or in a combination of two or more. Although the initiator is preferably used in an amount of 0.0001 to 0.5 mol based on the total polymerizable monomers, the amount of the initiator can be appropriately selected according to the types of the monomers used, the monomers used for copolymerization, and the initiator used.

In the polymerization reaction of the present invention, a solvent may be used where necessary. Examples of the solvent used include hydrocarbons such as hexane, cyclohexane and heptane; ketones such as acetone and methyl ethyl ketone; ethers such as dimethyl ether, diethyl ether and tetrahydrofuran; halogenated hydrocarbons such as dichloromethane, chloroform, carbon tetrachloride, dichloroethane and trichloroethane; aromatic hydrocarbons such as benzene and toluene; and aprotic polar solvents such as N,N-dimethylformamide and dimethyl sulfoxide. Aprotic polar solvents such as N,N-dimethylformamide and dimethyl sulfoxide are particularly preferably used. The amount of the solvent used can be appropriately selected according to the type of the solvent, the monomers used for copolymerization, the initiator used, the reaction conditions, etc.

In this method, the reaction temperature is not specifically limited, but usually in the range of −76° C. to the boiling temperature of the solvent. However, the reaction preferably takes place at an appropriate temperature according to the initiator used and the monomers used for copolymerization. In the method of the present invention, the reaction time cannot be specifically defined, but is usually 0.5 to 48 hours. The solvent can be removed by distillation as a conventional technique from the reaction solution thus produced containing the polymer comprising one or more units represented by the formula (1) in the molecule. Alternatively, the target polymer comprising one or more units represented by the formula (1) in the molecule can be collected by mixing the reaction solution with a homogeneous solvent in which the polymer comprising one or more units represented by the formula (1) in the molecule is insoluble, such as water, an alcohol such as methanol or ethanol, or an ether such as dimethyl ether, diethyl ether or tetrahydrofuran, to reprecipitate the polymer. The polymer thus obtained which comprises one or more units represented by the formula (1) in the molecule can be isolated and purified if necessary. There are no specific limitations to the isolation and purification method. A method of reprecipitating the polymer comprising one or more units represented by the formula (1) in the molecule using a solvent in which the polymer is insoluble, or a method using column chromatography can be used.

(Method (C) for Producing Polymer Represented by Formula (1))

From the polymer represented by the formula (1) comprising a unit represented by the formula (801), wherein $R_{801}$ is OH, a halogen atom, ONa or OK, the polymer represented by the formula (1) comprising a unit represented by the formula (802), wherein R is $-A_{802}-SO_3R_{802}$, can be synthesized by using an esterifying agent such as trimethylsilyldiazomethane, trimethyl orthoformate or triethyl orthoformate. The reaction will be described in detail below.

(1)

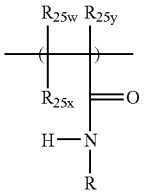

In the formula, R represents $-A_{25}-SO_2R_{25}$, $R_{25w}$, $R_{25x}$ and $R_{25y}$ form a combination selected from the group consisting of combinations described in (i) or (ii) below, and $A_{25}$ and $R_{25}$ form a combination selected from the group consisting of combinations described in (i-A) or (i-B) below in the case of (i), or $A_{25}$ and $R_{25}$ form a combination selected from the group consisting of combinations described in (ii-A) in the case of (ii), the combinations wherein (i) $R_{25w}$ and $R_{25x}$ are a hydrogen atom, and $R_{25y}$ is a $CH_3$ group or a hydrogen atom;

(i-A) $A_{25}$ is a substituted or unsubstituted aliphatic hydrocarbon structure, $R_{25}$ is a halogen atom or $OR_{25a}$, and $R_{25a}$ is a substituted or unsubstituted aliphatic hydrocarbon structure, a substituted or unsubstituted aromatic ring structure, or a substituted or unsubstituted heterocyclic structure;

(i-B) $A_{25}$ is a substituted or unsubstituted aromatic ring structure, or a substituted or unsubstituted heterocyclic structure, $R_{25}$ is OH, a halogen atom, ONa, OK or $OR_{25a}$, and $R_{25a}$ is a substituted or unsubstituted aliphatic hydrocarbon structure, a substituted or unsubstituted aromatic ring structure, or a substituted or unsubstituted heterocyclic structure;

(ii) $R_{25w}$ and $R_{25x}$ are independently a halogen atom or a hydrogen atom, $R_{25y}$ is a $CH_3$ group, a halogen atom or a hydrogen atom, and at least one of $R_{25w}$, $R_{25x}$ and $R_{25y}$ are a halogen atom; or (ii-A) $A_{25}$ is any of a substituted or unsubstituted aliphatic hydrocarbon structure, a substituted or unsubstituted aromatic ring structure, or a substituted or unsubstituted heterocyclic structure, $R_{25}$ is OH, a halogen atom, ONa, OK or $OR_{25a}$, and $R_{25a}$ is any of a substituted or unsubstituted aliphatic hydrocarbon structure, a substituted or unsubstituted aromatic ring structure, or a substituted or unsubstituted heterocyclic structure.

(801)

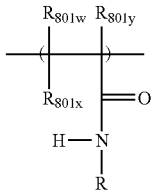

In the formula, R is $-A_{801}-SO_2R_{801}$, $R_{801w}$ and $R_{801x}$ are independently a halogen atom or a hydrogen atom, $R_{801y}$ is a $CH_3$ group, a halogen atom or a hydrogen atom, $R_{801}$ is OH, a halogen atom, ONa or OK, and $A_{801}$ is a substituted or unsubstituted aliphatic hydrocarbon structure, a substituted or unsubstituted aromatic ring structure, or a substituted or unsubstituted heterocyclic structure.

(802)

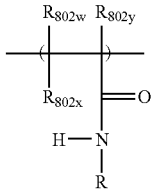

In the formula, R represents $-A_{802}-SO_3R_{802}$, $R_{802w}$ and $R_{802x}$ are independently a halogen atom or a hydrogen atom, $R_{802y}$ is a $CH_3$ group, a halogen atom or a hydrogen atom, and $A_{802}$ and $R_{802}$ are independently any of a substituted or unsubstituted aliphatic hydrocarbon structure, a substituted or unsubstituted aromatic ring structure, or a substituted or unsubstituted heterocyclic structure.

In this reaction, a solvent may be used where necessary. Examples of the solvent used include hydrocarbons such as hexane, cyclohexane and heptane; alcohols such as methanol and ethanol; ethers such as dimethyl ether, diethyl ether, tetrahydrofuran and dioxane; halogenated hydrocarbons such as dichloromethane, chloroform, carbon tetrachloride, dichloroethane and trichloroethane; aromatic hydrocarbons such as benzene and toluene; aprotic polar solvents such as N,N-dimethylformamide and dimethyl sulfoxide; and a pyridine derivative. Chloroform and methanol are particularly preferably used. The amount of the solvent used can be appropriately selected according to the starting material, the reaction conditions, etc.

The esterifying agent is used in an amount of 0.1 to 50 mol, and more preferably 1 to 20 mol per mol of the unit represented by the formula (801).

In this method, the reaction temperature is not specifically limited, but usually in the range of −20° C. to 30° C. The reaction time cannot be specifically defined, but is usually 1 to 48 hours.

The solvent can be removed by distillation as a conventional technique from the reaction solution thus produced containing the polymer comprising one or more units represented by the formula (802) in the molecule. Alternatively, the target polymer comprising one or more units represented by the formula (802) in the molecule can be collected by mixing the reaction solution with a homogeneous solvent in which the polymer comprising one or more units represented by the formula (802) in the molecule is insoluble, such as water, an alcohol such as methanol or ethanol, or an ether such as dimethyl ether, diethyl ether or tetrahydrofuran, to reprecipitate the polymer. The polymer thus obtained which comprises one or more units represented by the formula (802) in the molecule can be isolated and purified if necessary. There are no specific limitations to the isolation and purification method. A method of reprecipitating the polymer comprising one or more units represented by the formula (802) in the molecule using a solvent in which the polymer is insoluble, or a method using column chromatography can be used.

In the present invention, it is preferable to use a polymer comprising a unit of the formula (1) having a ratio (Mw/Mn) of the weight average molecular weight (Mw) to the number average molecular weight (Mn), the average molecular weights measured as above, of 1 to 10.

The above polymer used in the present invention preferably comprises a monomer unit of the formula (1) at 0.2% to 40% on a unit basis and has a number average molecular weight of 1,000 to 200,000. If the percentage of the unit of the formula (1) is lower than 0.2%, the polymer may have poor capability of inducing positive charges in a toner. On the other hand, if the percentage of the unit of the formula (1) is higher than 40%, the polymer may exhibit poor environmental stability such as moisture resistance, have inferior coating characteristics, etc. If the polymer used has a number average molecular weight of less than 1,000, the toner tends to be attached to or adhere to the resin layer since the polymer has too much a low-molecular-weight component, and thus the resin layer may exhibit reduced charging properties.

On the other hand, if the polymer has a number average molecular weight of more than 200,000, the polymer has poor compatibility with other resins forming the resin layer, and thus may not have chargeability stable against environmental change or over time. If the polymer has too high a molecular weight, the resin viscosity is high in the solvent, thereby causing coating defects, the resin layer for coating has a nonuniform composition, and the toner is charged in an unstable manner, and the resin-coating layer has unstable surface roughness, which may result in reduced abrasion resistance, etc.

Generally, a binder resin for a toner has a glass transition temperature of about 50 to 70° C. in many cases. Therefore, when using the above-described polymer, in order to avoid attachment of a toner to the surface of the resin layer formed by coating a core material, it is preferable to select materials appropriately to provide a polymer for coating, so that a coating film (resin layer) having a glass transition temperature higher than the glass transition temperature of the toner is formed.

The resin-coated carrier for an electrophotographic developer of the present invention is formed by coating a core material with the resin material as described above. The material for the carrier core material used herein may be a conventionally known magnetic material. Examples thereof include ferromagnetic metals such as iron, cobalt and nickel; alloys, compounds or the like of magnetite, hematite, ferrite, etc.; and particles obtained by dispersing these magnetic materials in a binder resin. In addition, resin core particles obtained by dispersing a magnetic material in a binder resin can also be used.

The carrier core material used in the present invention has a mean particle size of preferably 20 to 100 μm, and particularly preferably 30 to 65 μm. Specifically, if such a material has a mean particle size of less than 20 μm, a fine powder dominates the carrier particle distribution, each particle is magnetized at a low degree, and the carrier tends to scatter. When the carrier core material has a mean particle size of above 100 μm, such a material has a reduced specific surface area, and the toner tends to scatter. In this case, in particular, the solid area tends to be poorly reproduced in a full-color image with a large solid area.

The surface of the above-described carrier is coated with a resin by forming a coating resin layer on the surface of the core material as mentioned above using a resin containing at least the above-described polymer. Examples of the solvent used herein include toluene, xylene, methyl ethyl ketone, methyl isobutyl ketone and cellosolve acetate.

The surface of the core material which constitutes the resin-coated carrier for an electrophotographic developer of the present invention is coated with the resin-coating layer in an amount of 0.1 to 5.0 wt % based on the total resin-coated carrier, when the polymer comprising a unit of the formula (1) is used alone as the resin-coating layer, or in an amount of preferably 0.1 to 25 wt % based on the total resin-coated carrier depending upon the mixing ratio of the polymer to other resins, when the polymer is used in combination with other resins for the resin-coating layer. The baking equipment for forming the resin-coating layer may be an external heating equipment or an internal heating equipment, for example, a fixed or fluid electric furnace, a rotary electric furnace, a burner furnace or baking equipment using a microwave. The baking temperature is preferably about 130 to 300° C.

The above-described polymer as a carrier-coating resin may be crosslinked with a melamine aldehyde resin or an isocyanate, and may be used in combination with other known resins such as, for example, polyolefin resins such as polyethylene and polypropylene; polyvinyl resins and polyvinylidene resins such as polystyrene, an acrylic resin, polyacrylonitrile, polyvinyl acetate, polyvinyl alcohol, polyvinyl butyral, polyvinyl chloride, polyvinylcarbazole, polyvinyl ether and polyvinyl ketone; a vinyl chloride-vinyl acetate copolymer; a styrene-acrylic acid copolymer; a straight silicone resin composed of an organosiloxane bond or its modified product; fluororesins such as polytetrafluoroethylene, polyvinyl fluroride, polyvinylidene fluoride and polychlorotrifluoroethylene; a silicone resin; polyester; polyurethane; polycarbonate; a phenol resin; amino resins such as an urea-formaldehyde resin, a melamine resin, a benzoguanamine resin, an urea resin and a polyamide resin; and an epoxy resin. In the present invention, of these resins, fluororesins and/or silicone resins are preferably used. Fluororesins and/or silicone resins are advantageously used as the above resins, because carrier contamination (impaction) by a toner or additive can be effectively prevented.

In particular, in order to allow the used toner to be triboelectrically positively charged, the resin-coating layer may comprise, in addition to the above-described polymer as a carrier-coating resin, 30 to 70 wt % of a fluorine-containing polymer, for example, polyvinyl fluroride, polyvinylidene fluoride, polytrifluoroethylene, polytetrafluoroethylene, polyperfluoropropylene, a copolymer of vinylidene fluoride with vinyl fluoride, a copolymer of tetrafluoroethylene with hexafluoropropylene, a copolymer of vinylidene fluoride with trifluorochloroethylene or a copolymer of vinylidene fluoride with hexafluoropropylene.

As described above, a silicone resin may be used in addition to the above carrier-coating resin. Any straight silicone resin composed of an organosiloxane bond can be used. Specific examples include commercially available products such as KR-271 and KR-255 manufactured by Shin-Etsu Chemical Co., Ltd.; SR-2410, SR-2406 and SR-2411 manufactured by Dow Corning Toray Co., Ltd.; and TSR-127B and TSR-144 manufactured by GE Toshiba Silicones Co., Ltd. A catalyst or the like may be added to these straight silicone resins where necessary. As a modified silicone resin, a silicone resin modified from an alkyd resin, a polyester resin, an epoxy resin, a polyurethane resin, an acrylic resin or the like can be used. Examples of commercially available products thereof include KR-206 (modified alkyd resin), KR-9706 (modified acrylic resin) and ES-1001N (modified epoxy resin) manufactured by Shin-Etsu Chemical Co., Ltd.; and SR-2101 (modified alkyd resin) manufactured by Dow Corning Toray Co., Ltd.

The resin-coated carrier for an electrophotographic developer of the present invention is used in a mixture with a toner as a two-component developer in forming an image. The toner used herein is obtained by dispersing a colorant and, where necessary, various additives such as a charge control agent in a binder resin.

Examples of the binder resin used for a toner include, but are not specifically limited to, polyester, polystyrene; polymer compounds obtained from a styrene derivative such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer and a styrene-acrylonitrile-indene copolymer; polyvinyl chloride, a phenol resin, a modified phenol resin, a maleic resin, an acrylic resin, a methacrylic resin, polyvinyl acetate and a silicone resin; polyester resins having, as a structural unit, a monomer selected from the group consisting of an aliphatic polyhydric alcohol, aliphatic dicarboxylic acid, aromatic dicarboxylic acid, an aromatic dialcohol and a diphenol; a polyurethane resin, a polyamide resin, polyvinyl butyral, a terpene resin, a coumarone-indene resin and a petroleum resin. These may be used singly or in a mixture of two or more.

A toner having a core/shell structure with a core formed of a low-softening substance is also preferably used. The toner employs a low-softening substance, and is thus advantageous for fixing at a low temperature.

The low-softening substance is incorporated in toner particles by setting the material polarity in an aqueous medium of the low-softening substance lower than that of a main monomer, and adding a small amount of a highly polar resin or monomer, so that toner particles with a so-called core/shell structure, in which the low-softening substance is coated with a shell resin, can be obtained.

The particle size distribution and the particle size of a toner is controlled by changing the type and the amount added of an inorganic salt poorly soluble in water or a dispersant with a protective colloid action, or by controlling mechanical equipment conditions, for example, the circumferential speed of a roller, the number of passes, stirring conditions such as the shape of a stirring blade, the shape of a container, or the solid concentration in an aqueous medium, so that a predetermined toner can be obtained.

Examples of the shell resin for a toner include a styrene-(meth)acrylic acid copolymer, a polyester resin, an epoxy resin and a styrene-butadiene copolymer.

In obtaining toner particles directly by polymerization, monomers of the above polymers are preferably used. Specifically, styrene; styrene monomers such as o(m-, p-) -methylstyrene and m(p-)-ethylstyrene; acrylic acid ester monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate and diethylaminoethyl acrylate; methacrylic acid ester monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate and diethylaminoethyl methacrylate; and ene monomers such as butadiene, isoprene, cyclohexene, acrylonitrile, methacrylonitrile and acrylic acid amide are preferably used.

At least silica fine particles and/or titanium oxide fine particles are preferably used as an additive in the toner, since the developer can be provided with good flowability and has an increased useful life. Further, use of these fine powders can make the developer less changeable depending on the environment.

As other additives, metal oxide fine powders (aluminum oxide, strontium titanate, cerium oxide, magnesium oxide, chromium oxide, tin oxide, zinc oxide, etc.), nitride fine powders (silicon nitride, etc.), carbide fine powders (silicon carbide, etc.), metal salt fine powders (calcium sulfate, barium sulfate, calcium carbonate, etc.), fatty acid metal salt fine powders (zinc stearate, calcium stearate, etc.), carbon black, and resin fine powders (polytetrafluoroethylene, polyvinylidene fluoride, polymethyl methacrylate, polystyrene, a silicone resin, etc.) are preferable. These additives may be used singly or in a combination of two or more. The above additives including a silica fine powder are more preferably made hydrophobic.

The above-described additive preferably has a number average particle size of 0.2 μm or less. If the number average particle size is above 0.2 μm, the toner has reduced flowability, and provides an image with poor quality during development and transfer. The additive is used in an amount of preferably 0.01 to 10 parts by weight, and more preferably 0.05 to 5 parts by weight based on 100 parts by weight of toner particles. The additive has a nitrogen adsorption specific surface area by BET of preferably 30 $m^2/g$ or larger, and more preferably 50 to 400 $m^2/g$. The toner particles can be mixed with the additive by use of a mixer such as a Henschel mixer.

In the present invention, as the colorant used for a toner, the following colorants can be mentioned.

As the yellow colorant, compounds typified by a condensed azo compound, an isoindolynone compound, an anthraquinone compound, an azometal complex, a methine compound and an allylamide compound are used. Specifically, C.I. pigment yellows 12, 13, 14, 15, 17, 62, 74, 83, 93, 94, 95, 109, 110, 111, 128, 129, 147 and 168 can be suitably used.

As the magenta colorant, a condensed azo compound, a diketopyrrolopyrrole compound, anthraquinone, a quinacridone compound, a base dye lake compound, a naphthol compound, a benzimidazolone compound, a thioindigo compound and a perylene compound are used. Specifically, C.I. pigment reds 2, 3, 5, 6, 7, 23, 48:2, 48:3, 48:4, 57:1, 81:1, 144, 146, 166, 169, 177, 184, 185, 202, 206, 220, 221 and 254 can be suitably used.

As the cyan colorant, a copper phthalocyanine compound and its derivative, an anthraquinone compound and a base dye lake compound can be mentioned. Specifically, C.I. pigment blues 1, 7, 15, 15:1, 15:2, 15:3, 15:4, 60, 62, and 66 can be suitably used.

These colorants may be used singly, in a mixture of two or more, or as a solid solution.

As the black colorant, carbon black and a colorant toned to black using the yellow/magenta/cyan colorant shown above can be mentioned. For full-color applications, a magnetic toner may be used only in the case of a black toner to apply magnetic one-component development.

The colorant in the case of a color toner is selected taking into consideration the hue angle, saturation, brightness, weather resistance, OHP transparency and dispersibility into the toner. The content of the colorant is preferably 1 to 20 parts by weight based on 100 parts by weight of the binder resin for a toner.

A known charge control agent can be used for a toner. In the case of a color toner, a charge control agent which is colorless or light-colored, can charge the toner fast, and can maintain a constant charge quantity in a stable manner is particularly preferable. Further, in the present invention, when the toner is produced by polymerization, a charge control agent which does not inhibit polymerization and does not contain a substance soluble in an aqueous medium is particularly preferable.

Examples of the negative charge control agent preferably used include metal compounds of salicylic acid, dialkylsalicylic acid, naphthoic acid and dicarboxylic acid or their derivatives; a polymer compound having sulfonic acid or carboxylic acid in the side chain; a boron compound; an urea compound; a silicon compound; and calixarene. Examples of the positive charge control agent include a quaternary ammonium salt; a polymer compound having the quaternary ammonium salt in the side chain; a guanidine compound; and an imidazole compound. The content of the charge control agent is preferably 0.5 to 10 parts by weight based on 100 parts by weight of the binder resin. However, the charge control agent does not have to be added to toner particles.

Examples of the method for producing toner particles include a method comprising sufficiently mixing the above-described materials such as the binder resin, charge control agent and colorant in a mixer such as a Henschel mixer, kneading the mixture in a biaxial extruder, then cooling the mixture, granulating the mixture in a mill such as a feather mill, then providing particles with a desired particle size using a jet mill, a classifier or the like, and, where necessary, adding an additive such as a silica fine powder to the particles and mixing the components in a mixer; a method of directly producing toner particles by suspension polymerization; dispersion polymerization comprising directly producing toner particles using an aqueous organic solvent in which a monomer is soluble but a polymer obtained therefrom is insoluble; and a method for producing toner particles using emulsion polymerization typified by soap-free polymerization comprising direct polymerization in the presence of a water-soluble polar polymerization initiator and thereby producing toner particles.

When the toner particles are produced by polymerization, as the polymerization initiator, an azo polymerization initiator such as 2,2'-azobis(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile or azobisisobutylonitrile; or a peroxide polymerization initiator such as benzoyl peroxide, methyl ethyl ketone peroxide, diisopropyl peroxycarbonate, cumene hydroperoxide, 2,4-dichlorobenzoyl peroxide or lauroyl peroxide is used.

The polymerization initiator is added and used in an amount of generally 0.5 to 20 weight % based on a monomer, in which such an amount varies in accordance with the target polymerization degree. One or a mixture of the polymerization initiators of types differing a little according to the polymerization method is used with reference to the 10-hour half life temperature. A known crosslinking agent, chain transfer agent, polymerization inhibitor, etc. for controlling the polymerization degree may be further added and used.

When suspension polymerization is used for producing a toner, a dispersant is employed. Examples thereof include inorganic oxides such as tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. Further examples include organic compounds such as polyvinyl alcohol, gelatin, methylcellulose, methylhydroxypropylcellulose, ethylcellulose, a sodium salt of carboxymethylcellulose and starch. These are used as a dispersion in a water phase. These dispersants are preferably used in an amount of 0.2 to 10.0 parts by weight based on 100 parts by weight of the polymerizable monomer system.

As these dispersants, commercially available products may be used as is, or alternatively the inorganic compounds may be produced with high-speed stirring in a dispersion medium in order to obtain fine dispersed particles with a uniform particle size. For example, in the case of tricalcium phosphate, a dispersant preferable for suspension polymerization can be obtained by mixing an aqueous sodium phosphate solution with an aqueous calcium chloride solution with high-speed stirring. Further, in order to refine these dispersants, 0.001 to 0.1 part by weight of a surfactant may be used in combination. Specifically, a commercially available non-ionic, anionic or cationic surfactant can be used. Sodium dodecylsulfate, sodium tetradecylsulfate, sodium pentadecylsulfate, sodium octylsulfate, sodium oleate, sodium laurate, potassium stearate or calcium oleate is preferably used, for example.

When direct polymerization is used for producing a toner, the toner can be specifically produced by the production method as follows. An additive composed of a low-softening substance such as a release agent, a colorant, a charge control agent or a polymerization initiator is added to a monomer, and the components are homogeneously dissolved or dispersed using a homogenizer, an ultrasonic dispersing machine, etc. to obtain a monomer composition, and the monomer composition is dispersed in an aqueous phase containing a dispersion stabilizer using a conventional stirrer, homomixer, homogenizer, etc. Preferably, granulation is carried out by adjusting the stirring rate and the stirring time so that droplets composed of the monomer composition have a desired toner particle size. After that, it is sufficient if stirring is carried out to the extent that the particle state can be maintained and sedimentation of the particles can be prevented by the action of the dispersion stabilizer. The polymerization temperature is set at 40° C. or higher, and generally 50 to 90° C. to carry out polymerization. The polymerization temperature may be raised in the latter half of the polymerization reaction. Further, in order to improve durability, a part of the aqueous medium may be removed by distillation in the latter half of the reaction or after termination of the reaction for removing an unreacted polymerizable monomer and a by-product. After termination of the reaction, the produced toner particles are collected by washing and filtration and dried. In suspension polymerization, it is usually preferable to use water as a dispersion medium in an amount of 300 to 3,000 parts by weight based on 100 parts by weight of the monomer system.

The toner may be classified to control its particle size distribution, preferably by using a multidivision classifier utilizing an inertial force. By using this apparatus, a toner having a particle size distribution preferable for the present invention can be efficiently produced.

In the present invention, when the toner is mixed with the carrier to prepare a two-component developer, if the mixing ratio is set so that the toner concentration in the developer is 2 to 15 weight %, and preferably 4 to 13 weight %, good results can be obtained. If the toner concentration is less than 2 weight %, the image density tends to be low. If more than 15 weight %, fog or scattering in the apparatus tends to occur, and the developer tends to have a reduced useful life.

In the development method comprising carrying out development while replenishing a developer for replenishment, when the toner is mixed with the carrier to prepare a developer for replenishment, if the mixing ratio is set so that the toner is used in an amount of 2 to 50 parts by weight based on 1 part by weight of the carrier in the developer, good results can be obtained. If the toner is less than 2 parts by weight, the amount of the carrier is too large, and thus the charge quantity of the developer tends to increase, and the image density changes. If more than 50 parts by weight, the amount of the toner is extremely large, and thus the carrier deteriorates, and the charge quantity of the developer tends to decrease.

Next, the mean particle size and the particle size distribution of the toner used in the present invention are measured as follows.

0.1 to 5 ml of a surfactant (alkylbenzenesulfonic acid salt) is added to 100 to 150 ml of an electrolytic solution, and 2 to 20 mg of a measurement sample is added to the mixture. The electrolytic solution in which the sample is suspended is dispersed in an ultrasonic dispersing machine for one to three minutes, and the particle size distribution between 0.3 μm and 40 μm on a volume basis or the like is measured with a Coulter Counter Multisizer (manufactured by Beckman Coulter, Inc.) with apertures in accordance with an appropriate toner size such as 17 μm or 100 μm. The number average particle size and the weight average particle size measured under these conditions are determined by computer processing.

Next, the method for measuring the triboelectric charge quantity used in the present invention will be described. The toner is mixed with the resin-coated carrier of the present invention, so that the toner is 5 wt %, in a turbula mixer for 60 seconds. The developer is put in a container made of a metal equipped with a 500 mesh conductive screen on the bottom, and sucked by a suction machine to determine the triboelectric charge quantity from the difference in weight before and after aspiration and the electric potential stored in a condenser connected to the container. In this case, the suction pressure is 250 mmHg. By this method, the triboelectric charge quantity is calculated from the following formula:

$$Q(\mu C/g)=(C\times V)/(W1-W2)$$

wherein W1 is a weight before suction, W2 is a weight after suction, C is a volume of the condenser, and V is an electric potential stored in the condenser.

EXAMPLES

Hereinafter, the present invention will be described in detail by way of examples. The term "parts" indicated in the examples denotes parts by weight. First, toners and polymers used in the examples were prepared by the following methods.

Preparation Example 1 of Toner

Styrene-2-Ethylhexyl acrylate-dimethylaminoethyl methacrylate copolymer (copolymerization ratio=80:15:5): 100 parts by weight Copper phthalocyanine pigment: 5 parts by weight Low molecular weight polypropylene: 4 parts by weight The above materials were fully premixed, melt-kneaded, cooled, and then granulated to a particle size of approximately 1 to 2 mm in using a hammer mill. Then, they were pulverized in an air jet pulverizing mill. The obtained pulverized material was further classified by using an elbow jet classifier to obtain a positively chargeable fine powder in cyan color. A cyan toner No. 1 with a weight average particle size of 8.2 μm was prepared by mixing 100 parts by weight of the above cyan fine powder and 0.8 parts by weight of a positively chargeable hydrophobic colloidal silica treated with an amino-modified silicone oil with a Henschel mixer.

Preparation Example 2 of Toner

An aqueous solution of 0.1M-$Na_3PO_4$ of 450 parts was added to 710 parts of ion exchange water, and the mixture was heated to a temperature of 60° C., and then stirred at 12,000 rpm by using a T.K. Homomixer (manufactured by Tokusyu Kika Kogyo Co. Ltd.). 68 parts of a 1.0M-$CaCl_2$ aqueous solution was gradually added thereto to obtain an aqueous medium containing $Ca_3(PO_4)_2$.

Next, the following materials were provided.

| | |
|---|---|
| Styrene: | 165 parts |
| n-Butyl acrylate: | 35 parts |
| C.I. pigment blue 15:3 (colorant): | 12 parts |
| Charge control agent: | 3 parts |
| Saturated polyester (polar resin): | 10 parts |
| Ester wax (melting point: 70° C.): | 20 parts |

The above materials were heated to a temperature of 60° C., homogeneously dissolved and dispersed at 11,000 rpm by using a T.K. Homomixer (manufactured by Tokusyu Kika Kogyo Co. Ltd.). A polymerization initiator 2,2'-azobis(2,4-dimethylvaleronitrile) of 10 parts was dissolved in this to prepare a polymerizable monomer composition.

The polymerizable monomer composition was added to the aqueous medium, and the mixture was stirred at 60° C. in a nitrogen atmosphere at 11,000 rpm for 10 minutes by a T.K. Homomixer to granulate the polymerizable monomer composition. After that, the resultant was heated to 80° C. and reacted for 10 hours while stirred by a paddle stirring blade. After the polymerization reaction, the residual monomers were distilled away under reduced pressure, the resultant was cooled, and hydrochloric acid was added to dissolve $Ca_3(PO_4)_2$, etc., filtrated, water-washed, and dried to obtain positively chargeable cyan toner particles.

Onto 100 parts of the obtained cyan toner particles, 0.5 part of a positively chargeable hydrophobic colloidal silica (number average size of primary particles: 0.03 μm) treated with an amino-modified silicone oil, and 0.5 part of a positively chargeable hydrophobic titania powder (number average size of primary particles: 0.03 μm) treated with an amino-modified silicone oil were externally added to obtain a cyan toner No. 2 with a weight average particle size of 6.8 μm.

Next, preparation methods of polymers in the present invention will be described below Preparation Examples A to I In the following experiments, the structure determination of resulting polymers was, except otherwise specified, conducted by using DMSO-$d_6$ as the solvent and through measurements by $^1$H-NMR (FT-NMR: Brucker DPX400; resonance frequency: 400 MHz; measuring nuclide: $^1$H; measuring temperature: room temperature).

Further, analysis was conducted through Fourier-transform infrared absorption (FT-IR) spectroscopy (Nicolet AVATAR 360FT-IR).

Average molecular weights of resulting polymers was evaluated using gel permeation chromatography (GPC: Tosoh Corp.; column: Polymer Laboratories PLgel 5μ MIXED-C; solvent: DMF/LiBr 0.1% (w/v); in terms of polystyrene). Acid value titrations employed a potentiometric titration instrument AT510 (manufactured by Kyoto Electronics Manufacturing Co. Ltd.).

Preparation Example A-1

Referring to Makromol. Chem, 186, 1711-1720 (1985), a copolymer containing units represented by the following formula (A-0):

(A-0)

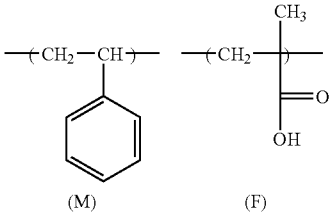

(M) (F)

in a (M):(F) content ratio (mol %) of 90:10 was synthesized and used for the following experiment.

In an atmosphere of nitrogen, 1.4998 g of this raw-material polymer and 1.3710 g of p-toluidine-2-sulfonic acid were put into a 200 ml three-necked flask; 56.5 ml of pyridine was added, and the mixture was stirred; and then 3.84 ml of triphenyl phosphite was added, and the mixture was heated at 120° C. for six hours. After the reaction, the resultant was reprecipitated in 565 ml of ethanol and recovered. The resulting polymer was rinsed for one day using 1 N hydrochloric acid, stirred for one day in water to be rinsed, and dried under reduced pressure. As a result of the IR measurement, the peak of 1,695 $cm^{-1}$ assigned to the carboxylic acid decreased, and the peak of 1,658 $cm^{-1}$ assigned to the amido group emerged anew.

From the result of $^1$H-NMR, since the peak assigned to the methyl group of p-toluidine-2-sulfonic acid shifted, the resulting polymer was confirmed to be a copolymer containing 10 mol % of units represented by the following formula (A-1):

(A-1)

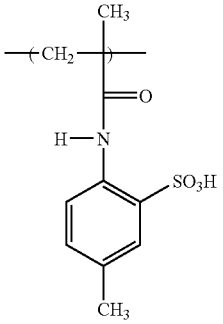

The resulting polymer had a number average molecular weight Mn of 22,000 and a weight average molecular weight Mw of 56,000.

Preparation Example A-2

0.9980 g of the polymer having the unit represented by the chemical formula (A-1), obtained in Preparation Example A-1, was put into a 300 ml round-bottomed flask and the polymer was dissolved by adding 70 ml of chloroform and 17.5 ml of methanol, and the solution was cooled to 0° C. 4.89 ml of a 2 mol/L trimethylsilyldiazomethane-hexane solution (manufactured by Sigma-Aldrich Corp.) was added, and the mixture was stirred for four hours. After the reaction, the solvent was distilled away with an evaporator, and the polymer was recovered. Further, the polymer was re-dissolved by adding 70 ml of chloroform and 17.5 ml of methanol, and the solvent was distilled away with an evaporator. This operation was repeated three times. The recovered polymer was dried under reduced pressure to obtain 0.9772 g of a polymer.

From the result of $^1$H-NMR, since the peak assigned to methyl sulfonate emerged at 3 to 4 ppm, the resulting polymer was confirmed to be a copolymer containing 10 mol % of units represented by the following formula (A-2):

(A-2)

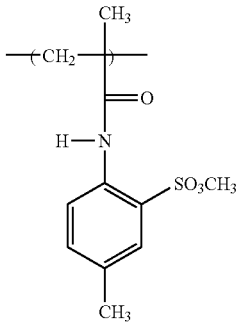

From the acid value titration, since an equivalent point assigned to sulfonic acid was not found, conversion of sulfonic acid to methyl sulfonate was made clear.

The resulting polymer had a number average molecular weight Mn of 22,000 and a weight average molecular weight Mw of 54,000. A large amount of the polymer was obtained by scaling up the series of the preparation methods, thus obtaining a polymer (a).

Preparation Example B-1

The same raw polymer as in Preparation Example A-1 was used.

In an atmosphere of nitrogen, 1.5052 g of the raw-material polymer and 1.1200 g of 2-amino-2-methylpropanesulfonic acid were put into a 200 ml three-necked flask; 56.5 ml of pyridine was added, and the mixture was stirred; and then 3.84 ml of triphenyl phosphite was added, and the mixture was heated at 120° C. for six hours. After the reaction, the resultant was reprecipitated in 565 ml of ethanol and recovered. The resulting polymer was rinsed for one day using 1 N hydrochloric acid, stirred for one day in water to be rinsed, and dried under reduced pressure.

As a result of the IR measurement, the peak of 1,695 $cm^{-1}$ assigned to the carboxylic acid decreased, and the peak of 1,668 $cm^{-1}$ assigned to the amido group emerged anew. From the result of $^{1}$H-NMR, since the peak assigned to the methyl group of 2-amino-2-methylpropanesulfonic acid shifted, the resulting polymer was confirmed to be a copolymer containing 8 mol % of units represented by the following formula (B-1):

(B-1)

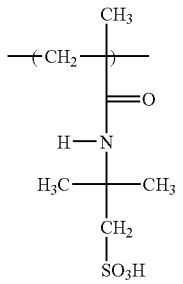

The resulting polymer had a number average molecular weight Mn of 20,000 and a weight average molecular weight Mw of 46,000.

Preparation Example B-2

0.9985 g of the polymer having the unit represented by the chemical formula (B-1), obtained in Preparation Example B-1, was put into a 300 ml round-bottomed flask. The polymer was dissolved by adding 70 ml of chloroform and 17.5 ml of methanol, and the mixture was cooled to 0° C. 4.89 ml of a 2 mol/L trimethylsilyldiazomethane-hexane solution (manufactured by Sigma-Aldrich Corp.) was added, and the mixture was stirred for four hours. After the reaction, the solvent was distilled away with an evaporator, and the polymer was recovered. Further, the polymer was re-dissolved by adding 70 ml of chloroform and 17.5 ml of methanol, and the solvent was distilled away with an evaporator. This operation was repeated three times. The recovered polymer was dried under reduced pressure to obtain 0.9350 g of a polymer. From the result of $^{1}$H-NMR, since the peak assigned to methyl sulfonate emerged at 3 to 4 ppm, the resulting polymer was confirmed to be a copolymer containing 8 mol % of units represented by the following formula (B-2):

(B-2)

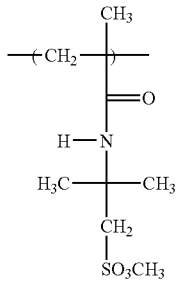

From the acid value titration, since an equivalent point assigned to sulfonic acid was not found, conversion of sulfonic acid to methyl sulfonate was made clear.

The resulting polymer has a number average molecular weight Mn of 18,000 and a weight average molecular weight Mw of 38,000. A large amount of the polymer was obtained by scaling up the series of the preparation methods, thus obtaining a polymer (b).

Preparation Example C-1

The same raw polymer as in Preparation Example A-1 was used.

In an atmosphere of nitrogen, 1.5060 g of this raw-material polymer and 1.6342 g of 1-naphthylamine-8-sulfonic acid were put into a 200 ml three-necked flask; 56.5 ml of pyridine was added, and the mixture was stirred; and then 3.84 ml of triphenyl phosphite was added, and the mixture was heated at 120° C. for six hours. After the reaction, the resultant was reprecipitated in ethanol of 565 ml and recovered. The resulting polymer was rinsed for one day using 1 N hydrochloric acid, stirred for one day in water to be rinsed, and dried under reduced pressure.

As a result of the IR measurement, the peak of 1,695 $cm^{-1}$ assigned to the carboxylic acid decreased, and the peak of 1,658 $cm^{-1}$ assigned to the amido group emerged anew. From the results of $^{1}$H-NMR, since the peak assigned to the naphthyl structure of 1-naphthylamine-8-sulfonic acid shifted, the resulting polymer was confirmed to be a copolymer containing 7 mol % of units represented by the following formula (C-1):

(C-1)

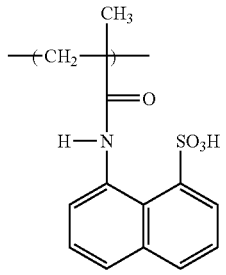

The resulting polymer had a number average molecular weight Mn of 21,000 and a weight average molecular weight Mw of 48,000.

Preparation Example C-2

1.0025 g of the polymer having the unit represented by the chemical formula (C-1), obtained in Preparation Example C-1, was put into a 300 ml round-bottomed flask. The polymer was dissolved by adding 70 ml of chloroform and 17.5 ml of methanol, and the mixture was cooled to 0° C. 4.89 ml of a 2 mol/L trimethylsilyldiazomethane-hexane solution (manufactured by Sigma-Aldrich Corp.) was added, and the mixture was stirred for four hours. After the reaction, the solvent was distilled away with an evaporator, and the polymer was recovered. Further, the polymer was re-dissolved by adding 70 ml of chloroform and 17.5 ml of methanol, and the solvent was distilled away with an evaporator. This operation was repeated three times. The recovered polymer was dried under reduced pressure to obtain 0.9668 g of a polymer. From the result of $^{1}$H-NMR, since the peak assigned to methyl sulfonate emerged at 3 to 4 ppm, the resulting polymer was confirmed to be a copolymer containing 7 mol % of units represented by the following formula (C-2):

(C-2)

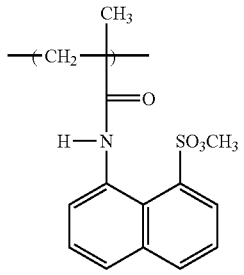

From the acid value titration, since an equivalent point assigned to sulfonic acid was not found, conversion of sulfonic acid to methyl sulfonate was made clear.

As a result, the number average molecular weight Mn was 20,000, and the weight average molecular weight Mw was 46,000. A large amount of the polymer was obtained by scaling up the series of the preparation methods, thus obtaining a polymer (c).

Preparation Example D-1

Poly(methyl methacrylate-co-methacrylic acid) manufactured by Sigma-Aldrich Corp. was used as the raw polymer. It was dissolved in chloroform, and reprecipitated in methanol, which operation was repeated three times, and the resultant precipitation was used for the following reaction. In an atmosphere of nitrogen, 1.5001 g of the polymer and 4.3320 g of 2-amino-1-naphthalenesulfonic acid were put into a 200 ml three-necked flask; 56.5 ml of pyridine was added, and the mixture was stirred; and then 10.17 ml of triphenyl phosphite was added, and the mixture was heated at 120° C. for six hours. After the reaction, the resultant was reprecipitated in 565 ml of ethanol and recovered. The resulting polymer was rinsed for one day using 1 N hydrochloric acid, stirred for one day in water to be rinsed, and dried under reduced pressure.

As a result of the IR measurement, the peak of 1,695 $cm^{-1}$ assigned to the carboxylic acid decreased, and the peak of 1,658 $cm^{-1}$ assigned to the amido group emerged anew.

From the result of $^1$H-NMR, since the peak assigned to the naphthyl structure of 2-amino-1-naphthalenesulfonic acid shifted, the resulting polymer was confirmed to be a copolymer containing 20 mol % of units represented by the following formula (D-1):

(D-1)

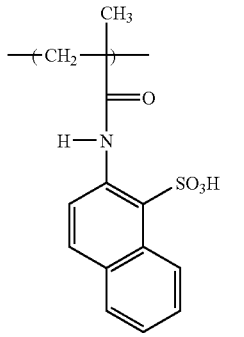

The resulting polymer had a number average molecular weight Mn of 12,000 and a weight average molecular weight Mw of 34,000.

Preparation Example D-2

0.9879 g of the polymer obtained in Preparation Example D-1 was put into a 300 ml round-bottomed flask. The polymer was dissolved by adding chloroform of 70 ml and methanol of 17.5 ml, and the mixture was cooled to 0° C. 12.94 ml of a 2 mol/L trimethylsilyldiazomethane-hexane solution (manufactured by Sigma-Aldrich Corp.) was added, and the mixture was stirred for four hours. After the reaction, the solvent was distilled away with an evaporator, and the polymer was recovered. Further, the polymer was re-dissolved by adding 70 ml of chloroform and 17.5 ml of methanol, and the solvent was distilled away with an evaporator. This operation was repeated three times. The recovered polymer was dried under reduced pressure to obtain 0.9662 g of a polymer.

From the result of $^1$H-NMR, since the peak assigned to methyl sulfonate emerged at 3 to 4 ppm, the resulting polymer was confirmed to be a copolymer containing 20 mol % of units represented by the following formula (D-2):

(D-2)

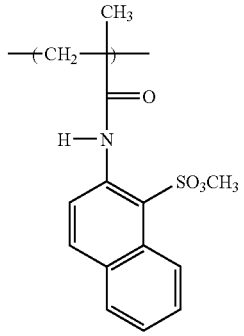

From the acid value titration, since an equivalent point assigned to sulfonic acid was not found, conversion of sulfonic acid to methyl sulfonate was made clear.

The resulting polymer had a number average molecular weight Mn of 11,000 and a weight average molecular weight Mw of 32,000. A large amount of the polymer was obtained by scaling up the series of the preparation methods, thus obtaining a polymer (d).

Preparation Example E-1

The same raw polymer as in Preparation Example D-1 was used.

In an atmosphere of nitrogen, 1.4889 g of this raw-material polymer and 4.8381 g of phenyl 2-aminobenzenesulfonate were put into a 200 ml three-necked flask; 56.5 ml of pyridine was added, and the mixture was stirred; and then 10.17 ml of triphenyl phosphite was added, and the mixture was heated at 120° C. for six hours. After the reaction, the resultant was reprecipitated in ethanol of 565 ml and recovered. The resulting polymer was rinsed for one day using 1 N hydrochloric acid, stirred for one day in water to be rinsed, and dried under reduced pressure.

As a result of the IR measurement, the peak of 1,695 $cm^{-1}$ assigned to the carboxylic acid decreased, and the peak of 1,658 $cm^{-1}$ assigned to the amido group emerged anew.

From the result of $^1$H-NMR, since the peak assigned to the aromatic ring structure of phenyl 2-aminobenzenesulfonate shifted, the resulting polymer was confirmed to be a copolymer containing 22 mol % of units represented by the following formula (E-1):

(E-1)

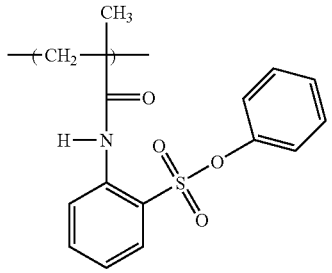

The resulting polymer had a number average molecular weight Mn of 13,000 and a weight average molecular weight Mw of 33,000. A large amount of the polymer was obtained by scaling up the series of the preparation methods, thus obtaining a polymer (e).

Preparation Example F-1

The same raw polymer as in Preparation Example D-1 was used.

In an atmosphere of nitrogen, 1.5024 g of this raw-material polymer and 3.3612 g of 2-aminobenzenesulfonic acid were put into a 200 ml three-necked flask; 56.5 ml of pyridine was added, and the mixture was stirred; and then 10.17 ml of triphenyl phosphite was added, and the mixture was heated at 120° C. for six hours. After the reaction, the resultant was reprecipitated in ethanol of 565 ml and recovered. The resulting polymer was rinsed for one day using 1 N hydrochloric acid, stirred for one day in water to be rinsed, and dried under reduced pressure.

As a result of the IR measurement, the peak of 1,695 $cm^{-1}$ assigned to the carboxylic acid decreased, and the peak of 1,658 $cm^{-1}$ assigned to the amido group emerged anew.

From the result of $^1$H-NMR, since the peak assigned to the aromatic ring structure of 2-aminobenzenesulfonic acid shifted, the resulting polymer was confirmed to be a copolymer containing 25 mol % of units represented by the following formula (F-1):

(F-1)

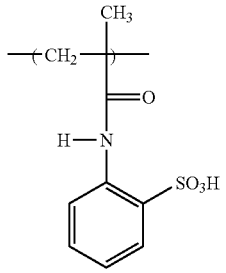

The resulting polymer had a number average molecular weight Mn of 14,000 and a weight average molecular weight Mw of 33,000.

Preparation Example F-2

1.0020 g of the polymer having the unit represented by the chemical formula (F-1), obtained in Preparation Example F-1, was put into a 300 ml round-bottomedround-bottomed flask. The polymer was dissolved by adding 70 ml of chloroform and 17.5 ml of methanol, and cooled to 0° C. 12.94 ml of a 2 mol/L trimethylsilyldiazomethane-hexane solution (manufactured by Sigma-Aldrich Corp.) was added, and the mixture was stirred for four hours. After the reaction, the solvent was distilled away with an evaporator, and the polymer was recovered. Further, the polymer was re-dissolved by adding 70 ml of chloroform and 17.5 ml of methanol, and the solvent was distilled away with an evaporator. This operation was repeated three times. The recovered polymer was dried under reduced pressure to obtain 0.9445 g of a polymer.

From the result of $^1$H-NMR, since the peak assigned to methyl sulfonate emerged at 3 to 4 ppm, the resulting polymer was confirmed to be a copolymer containing 24 mol % of units represented by the following formula (F-2):

(F-2)

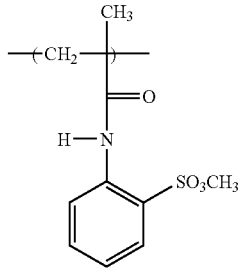

From the acid value titration, since an equivalent point assigned to sulfonic acid was not found, conversion of sulfonic acid to methyl sulfonate was made clear.

The resulting polymer had a number average molecular weight Mn of 13,000 and a weight average molecular weight Mw of 32,000. A large amount of the polymer was obtained by scaling up the series of the preparation methods, thus obtaining a polymer (f).

Preparation Example G-1

According to JOURNAL OF POLYMER SCIENCE: Polymer Chemistry Edition, 15, 585-591(1977), 100 g of a compound of the following formula (G-0):

(G-0)

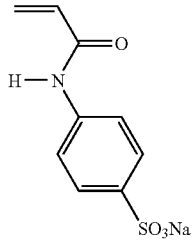

was synthesized, and used for the experiment.

The obtained compound was desalted using an ion exchange resin, and, referring to SYNTHETIC COMMUNICATIONS, 15 (12), 21, 1057-1062 (1985), a compound of the following formula (G-1):

(G-1)

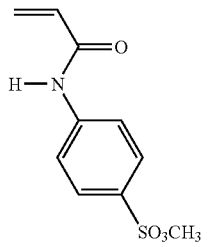

was synthesized.

In an atmosphere of nitrogen, 2.0010 g of the desalted product of the compound represented by the chemical formula (G-0), 20 ml of trimethyl orthoformate and p-benzoquinone as a polymerization inhibitor were put into a flask and the components were heated at 70° C. for five hours in a nitrogen stream. The reacted mixture was cooled, and concentrated under reduced pressure. It was rinsed twice by 3 L of water, and twice by 3 L of hexane, and then re-dissolved in chloroform and dried by magnesium sulfate anhydride, and the solvent was distilled away.

From the result of $^1$H-NMR, since the peak assigned to methyl sulfonate emerged at 3 to 4 ppm, conversion of sulfonic acid to methyl sulfonate was made clear.

From the elemental analysis, since the presence of Na was below the detection limit, it was implied that the methyl-esterification had progressed.

Further, from the acid value titration, since an equivalent point assigned to sulfonic acid was not found, conversion of sulfonic acid to methyl sulfonate was made clear.

This monomer was used for the next polymerization.

Preparation Example G-2

0.3015 g of the monomer obtained in Preparation Example G-1 and 2.7 ml of styrene were added to 30 ml of a test tube with a joint, dissolved by adding 20 ml of DMSO, and deaerated by nitrogen bubbling for 12 hours. 41.2 mg of 2,2'-azobis (isobutyronitrile) as the initiator was dissolved in 5.0 ml of DMSO. The solution was added to the test tube, and heated and stirred at 70° C. After nine hours, the resulting polymer was reprecipitated in methanol, rinsed in water; and the unreacted monomer and the homopolymer of (G-1) were removed to recover 0.9681 g of a polymer.

From the result of $^1$H-NMR, the resulting polymer was confirmed to be a copolymer containing 5 mol % of units represented by the following formula (G-2):

(G-2)

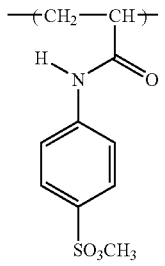

From the acid value titration, since an equivalent point assigned to sulfonic acid was not found, the polymerization without de-estrification of methyl sulfonate was made clear.

The resulting polymer had a number average molecular weight Mn of 10,000 and a weight average molecular weight Mw of 22,000. A large amount of the polymer was obtained by scaling up the series of the preparation methods, thus obtaining a polymer (g).

Preparation Example H-0

Referring to JOURNAL OF POLYMER SCIENCE: Polymer Chemistry Edition, 15, 585-591 (1977), a compound of the following formula (H-0):

(H-0)

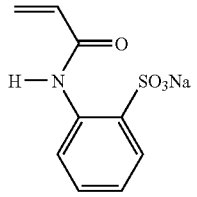

was synthesized.

50 g of 2-aminobenzenesulfonic acid as a raw material was dissolved in 120 ml of ion exchange water, and 12 g of sodium hydroxide was added. 24.5 g of sodium hydrogencarbonate was added to the resulting solution, 1.8 g of picric acid was further added, and then 26.1 g of acrylic acid chloride was added. The solution was stirred for 30 minutes, and filtrated to recover crystals, which were further rinsed using methanol to obtain white crystals.

The structure determination of the obtained compound was carried out by $^1$H-NMR. The monomer obtained here was used for the next polymerization.

Preparation Example H-1

0.3117 g of the monomer obtained in Preparation Example H-0 and 2.7 ml of styrene were added to a test tube with a joint of 30 ml, dissolved by adding 20 ml of DMSO, and deaerated by nitrogen bubbling for 12 hours. 41.2 mg of 2,2'-azobis (isobutyronitrile) as the initiator was dissolved in DMSO of 5.0 ml. The solution was added to the test tube, and heated and stirred at 70° C. After nine hours, the resulting polymer was purified using a dialysis membrane, rinsed using water and hydrochloric acid, thereby removing the unreacted monomer and the homopolymer of (H-0) to recover 0.9681 g of a polymer.

From the result of $^1$H-NMR, since the peak assigned to the phenyl structure of (H-0) shifted, the resulting polymer was confirmed to be a copolymer containing units of a (MM):(MF) content ratio (mol %) of 95:5 represented by the following formula (H-1):

(H-1)

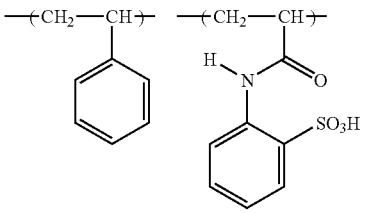

(MM) (MF)

The resulting polymer had a number average molecular weight Mn of 11,600 and a weight average molecular weight Mw of 23,500.

Preparation Example H-2

A 100 ml-round-bottomed flask was charged with 0.2995 g of the polymer obtained in Preparation Example H-1. The polymer was dissolved by adding chloroform of 21 ml and methanol of 5.25 ml, and the mixture was cooled to 0° C. 0.68 ml of a 2 mol/L trimethylsilyldiazomethane-hexane solution (manufactured by Sigma-Aldrich Corp.) was added, and the mixture was stirred for four hours. After the reaction, the solvent was distilled away with an evaporator, and the polymer was recovered. Further, the polymer was re-dissolved by adding 21 ml of chloroform and 5.25 ml of methanol, and the solvent was distilled away with an evaporator. This operation was repeated three times. The recovered polymer was dried under reduced pressure to obtain a 0.2880 g of polymer.

From the result of $^1$H-NMR, since the peak assigned to methyl sulfonate emerged at 3 to 4 ppm, the resulting polymer was confirmed to be a copolymer containing 5 mol % of units represented by the following formula (H-2):

(H-2)

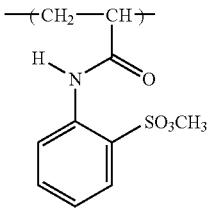

(MF)

From the acid value titration, since an equivalent point assigned to sulfonic acid was not found, conversion of sulfonic acid to methyl sulfonate was made clear.

The resulting polymer had a number average molecular weight Mn of 11,000 and a weight average molecular weight Mw of 23,000. A large amount of the polymer was obtained by scaling up the series of the preparation methods, thus obtaining a polymer (h).

Preparation Example I-1

Referring to JOURNAL OF POLYMER SCIENCE: Polymer Chemistry Edition, 13, 1879-1887 (1975), a copolymer containing units represented by the following formula (I-0):

(I-0)

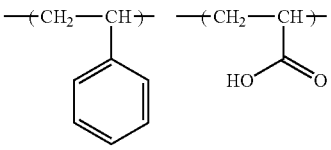

(NM) (NF)

in a (NM):(NF) content ratio (mol %) of 94:6 was synthesized and used for the following experiments.

A 200 ml-volume three-neck flask was charged with 1.5012 g of the polymer and 1.2868 g of 2-aminobenzenesulfonic acid in a nitrogen atmosphere; 56.5 ml of pyridine was added and the mixture was stirred; and then 3.89 ml of triphenyl phosphite was added, and the mixture was heated at 120° C. for six hours. After the reaction, pyridine was distilled away; the resultant was dissolved in 150 ml of ethyl acetate and purified by repeating three times separatory rinse using 2 N hydrochloric acid. Further, the solvent was distilled away; the polymer was dissolved in 15 ml of THF, reprecipitated in 200 ml of 2-propanol, recovered through filtration, and dried under reduced pressure.

From the result of $^1$H-NMR, since the peak assigned to the phenyl group of 2-aminobenzene sulfonic acid shifted, the resulting polymer was confirmed to be a copolymer containing 6 mol % of units represented by the following formula (1-1):

(I-1)

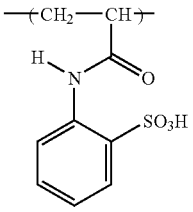

The resulting polymer had a number average molecular weight Mn of 23,000 and a weight average molecular weight Mw of 54,000.

Preparation Example I-2

A 300 ml-round-bottomed flask was charged with 0.9980 g of the polymer obtained in Preparation Example I-1. The polymer was dissolved by adding 70 ml of chloroform and 17.5 ml of methanol, and cooled to 0° C. 4.95 ml of a 2 mol/L trimethylsilyldiazomethane-hexane solution (manufactured by Sigma-Aldrich Corp.) was added, and the mixture was stirred for four hours. After the reaction, the solvent was distilled away with an evaporator, and the polymer was recovered. Further, the polymer was re-dissolved by adding 70 ml of chloroform and 17.5 ml of methanol, and the solvent was distilled away with an evaporator. This operation was repeated three times. The recovered polymer was dried under reduced pressure to obtain 0.9898 g of a polymer. From the result of $^1$H-NMR, since the peak assigned to methyl sulfonate emerged at 3 to 4 ppm, the resulting polymer was confirmed to be a copolymer containing 6 mol % of units represented by the following formula (I-2):

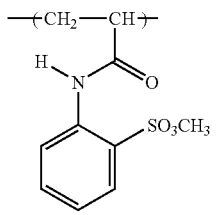

(I-2)

From the acid value titration, since an equivalent point assigned to sulfonic acid was not found, conversion of sulfonic acid to methyl sulfonate was made clear.

The resulting polymer had a number average molecular weight Mn of 22,000 and a weight average molecular weight Mw of 54,000. A large among of the polymer was obtained by scaling up the series of the preparation methods, thus obtaining a polymer (i).

Example 1

Carrier cores were prepared in the following manner. $Fe_2O_3$, CuO and ZnO were weighed in a molar ratio of 55 mol %, 25 mol % and 20 mol %, respectively, and mixed using a ball mill. Next, they were calcined and then pulverized in a ball mill, and further granulated in a spray dryer. These were sintered and further classified to obtain carrier core particles.

The obtained core particles were coated on their surface with a resin as follows.

A styrene-methyl methacrylate-2-ethylhexyl acrylate copolymer (copolymerization ratio of 40:50:10) was rendered to be a solution of 10 wt % in toluene as the solvent so that the coating resin amount corresponded to 2 wt % based on the carrier core, the polymer (a) was added in an amount of 5 wt % based on the solid content of the resin, and the mixture was then fully stirred to make a carrier coating solution.

The coating solution was applied to the above core material by using a coating apparatus in which a rotary bottom disk and stirring blades were provided in a fluidized bed and in which the coating was conducted while rotary flow was being formed. The above-described coating resin solution was sprayed from the direction perpendicular to the moving direction in the fluidized bed, and the spraying pressure of the coating resin solution was set to be 4 kg/cm$^2$. The solvent was removed by drying the resulting carrier in the fluidized bed at 80° C. for one hour, then obtaining coated carrier particles.

The particle size of the resulting carrier particles was 41 μm. The coating ratio of the carrier particles with the resin was measured by an electron microscope, thereby confirming the formation of a uniform resin-coating layer.

The resulting carrier and the toner No. 1 were mixed such that the toner concentration was 5.5 wt %, to obtain a developer.

By using the developer for evaluation, the image output was conducted under an N/N environment (23° C./60% RH) by using a blue developing machine of a remodeled analog copier NP4835 manufactured by Canon Inc. Then, variation in image density, fog on image after 50,000 sheets, environmental change in charge quantity and image smearing on a photosensitive member drum were used as indices for evaluation. The obtained results are shown in Table 1.

Example 2

The same carrier core particles as in Example 1 were coated with a resin as follows. A styrene-methyl methacrylate-2-ethylhexyl methacrylate copolymer (copolymerization ratio: 50:45:5) was rendered to be a 10 wt % solution in toluene as the solvent so that a coating resin amount corresponded to 2 wt % based on the carrier core, the polymer (b) was added in an amount of 5 wt % based on the solid content of the resin, and the mixture was then fully stirred to make a carrier coating solution. The carrier core material was coated with the coating solution as in Example 1 to obtain carrier particles.

The particle size of the obtained carrier particles was 40 μm. The coating ratio of the carrier particles with the resin was measured by an electron microscope, thereby confirming the formation of a uniform resin-coating layer.

A developer was prepared using the resulting carrier as in Example 1. The developer was evaluated as in Example 1. The results are shown in Table 1.

Examples 3 and 4

The surface of the carrier core particles used in Example 1 was coated with a resin as follows. A styrene-methyl methacrylate-2-hydroxylethyl methacrylate copolymer (copolymerization ratio of 35:57:8; hydroxyl value (KOH mg/g)=35) and a vinylidene fluoride-tetrafluoroethylene copolymer (copolymerization ratio: 75:25) of the same amount was rendered to be a solution of 10 wt % in the mixed solvent of acetone and methyl ethyl ketone (mixing weight ratio: 1:1) so that a coating resin amount corresponded to 2 wt % based on the carrier core. The polymer (b) in Example 3 and the polymer (c) in Example 4 were added respectively in an amount of 5 wt % based on the solid content of the resin, and the mixtures were then fully stirred to make carrier coating solutions. The carrier core material was coasted with the coating solutions as in Example 1 to obtain carrier particles.

The particle sizes of the obtained carrier particles were both 41 μm. The coating ratio of the carrier particles with the resin was measured by an electron microscope, thereby confirming the formation of a uniform resin-coating layer.

Developers were prepared using the resulting carriers as in Example 1. Further, the developers were evaluated as in Example 1. The results are shown in Table 1.

Examples 5 and 6

Carrier cores were prepared as the following manner. $Fe_2O_3$, CuO and ZnO were weighed in a molar ratio of 53 mol %, 25 mol % and 22 mol %, respectively, and mixed using a ball mill. They were calcined and then pulverized in a ball mill, and further granulated in a spray dryer. These were sintered and further classified to obtain carrier core particles with an average particle size of 65 μm. The obtained carrier core particles were coated on their surface with the same coating resin as in Example 1. The coating resin was rendered to be a 10 wt % solution of in toluene as the solvent so that a coating resin amount corresponded to 2 wt % based on the carrier core. The polymer (a) in Example 5 and, the polymer (b) in Example 6 were added respectively in an amount of 5 wt % based on the solid content of the resin, and the mixtures were then fully stirred to make carrier coating solutions. The carrier core material was coated with the coating solutions as in Example 1 to obtain carrier particles. The particle sizes of the obtained carrier particles were 66 μm. Developers were prepared using the resulting carriers as in Example 1. Further, the developers were evaluated as in Example 1. The results are shown in Table 1.

Comparative Example 1

A resin-coated carrier was prepared in the same manner as in Example 1 except that polymer (a) was not used. The resultant resin-coated carrier was used to prepare a developer in the same manner as in Example 1. The developer was evaluated in the same manner as in Example 1. Table 1 shows the results.

Comparative Example 2

A resin-coated carrier was prepared in the same manner as in each of Examples 5 and 6 except that neither polymer (a) nor polymer (b) was used. The resultant resin-coated carrier was used to prepare a developer in the same manner as in Example 1. The developer was evaluated in the same manner as in Example 1. Table 1 shows the results.

2. Fog on Image

The toner fog on white background images was measured by a REFLECTOMETER MODEL TC-6DS manufactured by Tokyo Denshoku Co. Ltd. and ranked based on the following standard.

○: less than 0.5%.

Δ: equal to or more than 0.5% and less than 1.5%.

▲: equal to or more than 1.5% and less than 2.5%.

X: equal to or more than 2.5%.

3. Environmental Change in Charge Quantity

The charge quantity Q (LL) after the developer was allowed to stand for one day at 15° C. and a humidity of 10% and the charge quantity Q (HH) after for one day at 30° C. and a humidity of 80% were calculated by using a measuring method described later of charge quantity; then the difference, ΔQ (=Q (LL)−Q (HH)) was obtained, and ranked on the following standard.

○: ΔQ was less than 10 μC.

Δ: ΔQ was equal to or more than 10 μC and less than 15 μC.

▲: ΔQ was equal to or more than 15 μC and less than 20 μC.

X: ΔQ was equal to or more than 20 μC.

TABLE 1

Copy evaluation results

| | Image density | | Image fog | | Environmental change in charge quantity | | Image smearing on photosensitive member drum (30° C., 80%) | |
|---|---|---|---|---|---|---|---|---|
| | Initial | After 50,000 sheets | Initial | After 50,000 sheets | Initial | After 50,000 sheets | Initial | After 50,000 sheets |
| Ex. 1 | ○ | ○ | ○ | ○ | ○ | ○ | ○ | ○ |
| Ex. 2 | ○ | ○ | ○ | ○ | ○ | ○ | ○ | ○ |
| Ex. 3 | ○ | ○ | ○ | ○ | ○ | ○ | ○ | ○ |
| Ex. 4 | ○ | ○ | ○ | ○ | ○ | ○ | ○ | ○ |
| Ex. 5 | ○ | ○ | ○ | ○ | ○ | ○ | ○ | ○ |
| Ex. 6 | ○ | ○ | ○ | ○ | ○ | ○ | ○ | ○ |
| Comparative Example 1 | Δ | ▲ | ▲ | ▲ | Δ | ▲ | ▲ | X |
| Comparative Example 2 | Δ | ▲ | ▲ | ▲ | Δ | X | ▲ | X |

<Evaluation>

Image forming tests of 50,000 sheets were conducted for evaluation. Variation in image density, fog on image, environmental change in the charge quantity and image smearing on a photosensitive member drum, which occurred in the tests, were evaluated by the following methods and on the following standards. Note that the evaluation in Tables 2 to 6 described later was similar thereto.

1. Image Density

Copying was conducted under suitable exposure conditions, and the image density in a solid part was measured by a Macbeth densitometer for evaluation of image density, and ranked on the following standard.

○: having no image unevenness and reproducing manuscript densities very well.

Δ: reproducing manuscript densities (at a level of having practically no problem).

▲: having ununiformity and density unevenness (at a level of having a practical problem).

X: having a large change in comparison to manuscript densities (at a level of having no practical use).

4. Image Smearing on a Photosensitive Member Drum

A half-tone image was formed by using a CLC700 at 30° C. and a humidity of 80%, and the image quality was rated based on the following standard.

○: exhibiting no image smearing.

Δ: exhibiting a little image smearing but at a level of having no practical problem.

▲: at a level of having a practical problem.

X: exhibiting image smearing on the entire surface, and at a level of having no practical use.

Examples 7 to 12

Resin-coated carriers, respectively, were obtained entirely as in Examples 1 to 6. The evaluation was conducted using the resulting carriers as in Examples 1 to 6, except for using the toner No. 2 instead of the toner No. 1. The results are shown in Table 2.

Comparative Examples 3 and 4

In each of Comparative Examples 3 and 4, a developer was prepared in the same manner as in each of Comparative Examples 1 and 2 except that the toner No. 2 was used instead of the toner No. 1. Each of the developers was evaluated in the same manner as in each of Comparative Examples 1 and 2. Table 2 shows the results.

TABLE 2

| | Copy evaluation results | | | | | | | |
|---|---|---|---|---|---|---|---|---|
| | Image density | | Image fog | | Environmental change in charge quantity | | Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 7 | ○ | ○ | ○ | ○ | ○ | ○ | ○ | ○ |
| Ex. 8 | ○ | ○ | ○ | ○ | ○ | ○ | ○ | ○ |
| Ex. 9 | ○ | ○ | ○ | ○ | ○ | ○ | ○ | ○ |
| Ex. 10 | ○ | ○ | ○ | ○ | ○ | ○ | ○ | ○ |
| Ex. 11 | ○ | ○ | ○ | ○ | ○ | ○ | ○ | ○ |
| Ex. 12 | ○ | ○ | ○ | ○ | ○ | ○ | ○ | ○ |
| Comparative Example 3 | Δ | X | ▲ | ▲ | Δ | X | ▲ | X |
| Comparative Example 4 | Δ | ▲ | ▲ | ▲ | Δ | ▲ | ▲ | X |

Example 13

Ferrite raw materials of oxides, 56.3 mol % of $Fe_2O_3$, 23.0 mol % of MgO and 20.7 mol % of SrO in molar ratio, were wet-mixed in a ball mill, dried and pulverized, and then calcined at 750° C. for two hours, and pulverized to approximately 0.1 to 1.0 mm by a crusher. Further, they were wet-pulverized to be made a slurry in a ball mill, followed by addition of polyvinyl alcohol of 1.0% as the binder and $CaCO_3$ of 3% as the porosity adjusting agent, granulated into globular particles by the spray drier method, baked in an atmosphere of nitrogen gas of an oxygen gas concentration of 0.5% at 950° C., screened through a screen with an aperture size of 250 μm to remove coarse particles, and next classified for particle size control by a pneumatic classifier (Elbow-Jet-Labo EJ-L3 manufactured by Nittetsu Mining Co. Ltd.), thus obtaining core material particles. Then, a mixture of the following composition was prepared.

Toluene/methyl ethyl ketone (4:1) mixed solvent: 1,000 parts

Styrene-methyl methacrylate copolymer (4:6; Mw=50,000): 50 parts

Polymer (a): 50 parts

A coating liquid was prepared using the above mixture. The formulation of a solution was so adjusted that the coating resin solid content became 10.0 weight % to the core material particles; the solution was dried under reduced pressure to remove the solvent while being stirred and mixed by a vacuum kneader, baked at 140° C. for two hours, screened with a screen of 74 μm in aperture size to obtain a resin-coated carrier with an average particle size of 35.3 μm (volume-average 50% particle size) and a BET specific surface area of 0.182 $m^2/g$.

A developer was prepared using the resulting carrier as in Example 1. The developer was evaluated as in Example 1. The results are shown in Table 3.

Examples 14 to 16

Resin-coated carriers, respectively, were obtained as in Example 13, except for using 80 parts of the styrene-methyl methacrylate copolymer (4:6; Mw=50,000), 20 parts of the polymer (a) and the coating resins respectively with solid contents of 15.0%, 20.0% and 25.0%. Developers were prepared using the resulting carriers as in Example 1. The developers were evaluated as in Example 1. The results are shown in Table 3.

Examples 17 to 20

Resin-coated carriers were obtained entirely as in Examples 13 to 16, respectively. The evaluation was conducted using the resulting carriers as in Examples 13 to 16, except for using the toner No. 2 instead of the toner No. 1. The results are shown in Table 3.

TABLE 3

| | Copy evaluation results | | | | | | | |
|---|---|---|---|---|---|---|---|---|
| | Image density | | Image fog | | Environmental change in charge quantity | | Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 13 | ○ | ○ | ○ | ○ | ○ | ○ | ○ | ○ |
| Ex. 14 | ○ | ○ | ○ | ○ | ○ | ○ | ○ | ○ |
| Ex. 15 | ○ | ○ | ○ | ○ | ○ | ○ | ○ | ○ |
| Ex. 16 | ○ | ○ | ○ | ○ | ○ | ○ | ○ | ○ |

TABLE 3-continued

| | Copy evaluation results | | | | | | | |
|---|---|---|---|---|---|---|---|---|
| | Image density | | Image fog | | Environmental change in charge quantity | | Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 17 | ○ | ○ | ○ | ○ | ○ | ○ | ○ | ○ |
| Ex. 18 | ○ | ○ | ○ | ○ | ○ | ○ | ○ | ○ |
| Ex. 19 | ○ | ○ | ○ | ○ | ○ | ○ | ○ | ○ |
| Ex. 20 | ○ | ○ | ○ | ○ | ○ | ○ | ○ | ○ |

Example 21

A resin-coated carrier was obtained as in Example 1, except for using the polymer (d) instead of the polymer (a). Evaluation was conducted using the resulting carrier as in Example 1. The results are shown in Table 4.

Example 22

A resin-coated carrier was obtained as in Example 2, except for using the polymer (e) instead of the polymer (b). Evaluation was conducted using the resulting carrier as in Example 1. The results are shown in Table 4.

Examples 23 and 24

Resin-coated carriers were obtained as in Examples 3 and 4, except for using the polymer (e) and the polymer (f) instead of the polymer (b) and the polymer (c), respectively. Evaluations were conducted using the resulting carrier as in Example 1. The results are shown in Table 4.

Examples 25 and 26

Resin-coated carriers were obtained as in Examples 5 and 6, except for using the polymer (d) and the polymer (e) instead of the polymer (a) and the polymer (b), respectively. Evaluations were conducted using the resulting carrier as in Example 1. The results are shown in Table 4.

TABLE 4

| | Copy evaluation results | | | | | | | |
|---|---|---|---|---|---|---|---|---|
| | Image density | | Image fog | | Environmental change in charge quantity | | Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 21 | ○ | ○ | ○ | ○ | ○ | Δ | ○ | ○ |
| Ex. 22 | ○ | ○ | ○ | ○ | ○ | ○ | ○ | ○ |
| Ex. 23 | ○ | ○ | ○ | ○ | ○ | ○ | ○ | ○ |
| Ex. 24 | ○ | ○ | ○ | ○ | ○ | ○ | ○ | ○ |
| Ex. 25 | ○ | ○ | ○ | ○ | ○ | Δ | ○ | Δ |
| Ex. 26 | ○ | ○ | ○ | ○ | ○ | ○ | ○ | ○ |
| Comparative Example 1 | Δ | ▲ | ▲ | ▲ | Δ | ▲ | ▲ | X |
| Comparative Example 2 | Δ | ▲ | ▲ | ▲ | Δ | X | ▲ | X |

Examples 27 to 32

Resin-coated carriers were obtained as in Examples 21 to 26, respectively. Evaluations were conducted using the resulting carriers as in Examples 21 to 26, except for using the toner No. 2 instead of the toner No. 1. The results are shown in Table 5.

TABLE 5

| | Copy evaluation results | | | | | | | |
|---|---|---|---|---|---|---|---|---|
| | Image density | | Image fog | | Environmental change in charge quantity | | Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 27 | ○ | ○ | ○ | ○ | ○ | Δ | ○ | Δ |
| Ex. 28 | ○ | ○ | ○ | ○ | ○ | ○ | ○ | ○ |
| Ex. 29 | ○ | ○ | ○ | ○ | ○ | ○ | ○ | ○ |
| Ex. 30 | ○ | ○ | ○ | ○ | ○ | ○ | ○ | ○ |
| Ex. 31 | ○ | ○ | ○ | ○ | ○ | Δ | ○ | Δ |
| Ex. 32 | ○ | ○ | ○ | ○ | ○ | ○ | ○ | ○ |
| Comparative Example 3 | Δ | X | ▲ | ▲ | Δ | X | ▲ | X |
| Comparative Example 4 | Δ | ▲ | ▲ | ▲ | Δ | ▲ | ▲ | X |

Example 33

A resin-coated carrier was obtained as in Example 13, except for using the polymer (d) instead of the polymer (a). Evaluation was conducted using the resulting carrier as in Example 1. The results are shown in Table 6.

Examples 34 to 36

Resin-coated carriers, respectively, were obtained as in Example 13, except for using 80 parts of the styrene-methyl methacrylate copolymer (4:6; Mw=50,000), 20 parts of the polymer (e) and the coating resins respectively with solid contents of 15.0%, 20.0% and 25.0%. Developers were prepared using the resulting carriers as in Example 1. The developers were evaluated as in Example 1. The results are shown in Table 6.

Examples 37 to 40

Resin-coated carriers were obtained entirely as in Examples 33 to 36. Evaluations were conducted using the resulting carriers as in Examples 33 to 36, except for using the toner No. 2 instead of the toner No. 1. The results are shown in Table 6.

TABLE 6

| | Copy evaluation results | | | | | | | |
|---|---|---|---|---|---|---|---|---|
| | Image density | | Image fog | | Environmental change in charge quantity | | Image Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 33 | ○ | ○ | ○ | ○ | ○ | ○ | ○ | ○ |
| Ex. 34 | ○ | ○ | ○ | ○ | ○ | ○ | ○ | ○ |
| Ex. 35 | ○ | ○ | ○ | ○ | ○ | ○ | ○ | ○ |
| Ex. 36 | ○ | ○ | ○ | Δ | ○ | Δ | ○ | ○ |
| Ex. 37 | ○ | ○ | ○ | ○ | ○ | ○ | ○ | ○ |
| Ex. 38 | ○ | ○ | ○ | ○ | ○ | ○ | ○ | ○ |
| Ex. 39 | ○ | ○ | ○ | ○ | ○ | ○ | ○ | ○ |
| Ex. 40 | ○ | ○ | ○ | Δ | ○ | Δ | ○ | Δ |

Example 41

A resin-coated carrier was obtained as in Example 1, except for using the polymer (g) instead of the polymer (a). Evaluation was conducted using the resulting carrier as in Example 1. The results are shown in Table 7.

Example 42

A resin-coated carrier was obtained as in Example 2, except for using the polymer (h) instead of the polymer (b). Evaluation was conducted using the resulting carrier as in Example 1. The results are shown in Table 7.

Examples 43 and 44

Resin-coated carriers were obtained as in Example 3 and 4, except for using the polymer (h) and the polymer (i) instead of the polymer (b) and the polymer (c), respectively. Evaluations were conducted using the resulting carriers as in Example 1. The results are shown in Table 7.

Examples 45 and 46

Resin-coated carriers were obtained as in Example 5 and 6, except for using the polymer (g) and the polymer (h) instead of the polymer (a) and the polymer (b), respectively. Evaluations were conducted using the resulting carriers as in Example 1. The results are shown in Table 7.

Example 53

A resin-coated carrier was obtained as in Example 13, except for using the polymer (g) instead of the polymer (a). Evaluation was conducted using the resulting carrier as in Example 1. The results are shown in Table 9.

Examples 54 to 56

Resin-coated carriers, respectively, were obtained as in Example 13, except for using 80 parts of the styrene-methyl methacrylate copolymer (4:6; Mw=50,000), 20 parts of the polymer (e) and the coating resins respectively with solid contents of 15.0%, 20.0% and 25.0%. Developers were prepared using the resulting carriers as in Example 1. The developers were evaluated as in Example 1. The results are shown in Table 9.

TABLE 7

| | Copy evaluation results | | | | | | | |
|---|---|---|---|---|---|---|---|---|
| | Image density | | Image fog | | Environmental change in charge quantity | | Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 41 | ○ | ○ | ○ | ○ | ○ | ○ | ○ | ○ |
| Ex. 42 | ○ | ○ | ○ | ○ | ○ | ○ | ○ | ○ |
| Ex. 43 | ○ | ○ | ○ | ○ | ○ | ○ | ○ | ○ |
| Ex. 44 | ○ | ○ | ○ | ○ | ○ | ○ | ○ | ○ |
| Ex. 45 | ○ | ○ | ○ | ○ | ○ | ○ | ○ | ○ |
| Ex. 46 | ○ | ○ | ○ | ○ | ○ | ○ | ○ | ○ |
| Comparative Example 1 | Δ | ▲ | ▲ | ▲ | Δ | ▲ | ▲ | X |
| Comparative Example 2 | Δ | ▲ | ▲ | ▲ | Δ | X | ▲ | X |

Examples 47 to 52

Resin-coated carriers, respectively, were obtained entirely as in Examples 41 to 46. Evaluations were conducted using the resulting carriers as in Examples 41 to 46, except for using the toner No. 2 instead of the toner No. 1. The results are shown in Table 8.

TABLE 8

| | Copy evaluation results | | | | | | | |
|---|---|---|---|---|---|---|---|---|
| | Image density | | Image fog | | Environmental change in charge quantity | | Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 47 | ○ | ○ | ○ | ○ | ○ | ○ | ○ | ○ |
| Ex. 48 | ○ | ○ | ○ | ○ | ○ | ○ | ○ | ○ |
| Ex. 49 | ○ | ○ | ○ | ○ | ○ | ○ | ○ | ○ |
| Ex. 50 | ○ | ○ | ○ | ○ | ○ | ○ | ○ | ○ |
| Ex. 51 | ○ | ○ | ○ | ○ | ○ | ○ | ○ | ○ |
| Ex. 52 | ○ | ○ | ○ | ○ | ○ | ○ | ○ | ○ |
| Comparative Example 3 | Δ | X | ▲ | ▲ | Δ | X | ▲ | X |
| Comparative Example 4 | Δ | ▲ | ▲ | ▲ | Δ | ▲ | ▲ | X |

Examples 57 to 60

Resin-coated carriers, respectively, were obtained as in Examples 53 to 56. Evaluations were conducted using the resulting carriers as in Examples 53 to 56, except for using the toner No. 2 instead of the toner No. 1. The results are shown in Table 9.

TABLE 9

| | Copy evaluation results | | | | | | | |
|---|---|---|---|---|---|---|---|---|
| | Image density | | Image fog | | Environmental change in charge quantity | | Image smearing on photosensitive member drum (30° C., 80%) | |
| | Initial | After 50,000 sheets | Initial | After 50,000 sheets | Initial | After 50,000 sheets | Initial | After 50,000 sheets |
| Ex. 53 | ○ | ○ | ○ | ○ | ○ | ○ | ○ | ○ |
| Ex. 54 | ○ | ○ | ○ | ○ | ○ | ○ | ○ | ○ |
| Ex. 55 | ○ | ○ | ○ | ○ | ○ | ○ | ○ | ○ |
| Ex. 56 | ○ | ○ | ○ | ○ | ○ | ○ | ○ | ○ |
| Ex. 57 | ○ | ○ | ○ | ○ | ○ | ○ | ○ | ○ |
| Ex. 58 | ○ | ○ | ○ | ○ | ○ | ○ | ○ | ○ |
| Ex. 59 | ○ | ○ | ○ | ○ | ○ | ○ | ○ | ○ |
| Ex. 60 | ○ | ○ | ○ | ○ | ○ | ○ | ○ | ○ |

This application claims priority from Japanese Patent Application No. 2004-188891 filed Jun. 25, 2004, which is hereby incorporated by reference herein.

What is claimed is:

1. A resin-coated carrier for an electrophotographic developer which comprises a resin-coating layer comprising, on a core material, a polymer comprising a unit represented by the formula (1):

(1)

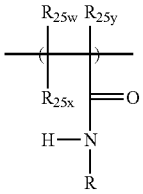

wherein R represents $-A_{25}-SO_2R_{25}$, $R_{25w}$, $R_{25x}$ and $R_{25y}$ form a combination selected from the group consisting of combinations described in (i) or (ii) below, and $A_{25}$ and $R_{25}$ form a combination selected from the group consisting of combinations described in (i-A) or (i-B) below in the case of (i), or $A_{25}$ and $R_{25}$ form a combination selected from the group consisting of combinations described in (ii-A) in the case of (ii), the combinations wherein (i) $R_{25w}$ and $R_{25x}$ are a hydrogen atom, and $R_{25y}$ is a $CH_3$ group or a hydrogen atom;

(i-A) $A_{25}$ is a substituted or unsubstituted aliphatic hydrocarbon structure, $R_{25}$ is a halogen atom or $OR_{25a}$, and $R_{25a}$ is a substituted or unsubstituted aliphatic hydrocarbon structure, a substituted or unsubstituted aromatic ring structure, or a substituted or unsubstituted heterocyclic structure;

(i-B) $A_{25}$ is a substituted or unsubstituted aromatic ring structure, or a substituted or unsubstituted heterocyclic structure, $R_{25}$ is OH, a halogen atom, ONa, OK or $OR_{25a}$, and $R_{25a}$ is a substituted or unsubstituted aliphatic hydrocarbon structure, a substituted or unsubstituted aromatic ring structure, or a substituted or unsubstituted heterocyclic structure;

(ii) $R_{25w}$ and $R_{25x}$ are independently a halogen atom or a hydrogen atom, $R_{25y}$ is a $CH_3$ group, a halogen atom or a hydrogen atom, and at least one of $R_{25w}$, $R_{25x}$ and $R_{25y}$ are a halogen atom; or (ii-A) $A_{25}$ is any of a substituted or unsubstituted aliphatic hydrocarbon structure, a substituted or unsubstituted aromatic ring structure, or a substituted or unsubstituted heterocyclic structure, $R_{25}$ is OH, a halogen atom, ONa, OK or $OR_{25a}$, and $R_{25a}$ is any of a substituted or unsubstituted aliphatic hydrocarbon structure, a substituted or unsubstituted aromatic ring structure, or a substituted or unsubstituted heterocyclic structure.

2. The resin-coated carrier according to claim 1, wherein the structure represented by the formula (1) is a unit represented by the formula (2):

(2)

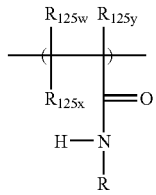

wherein R represents $-A_{125}-SO_2R_{125}$, $R_{125w}$, $R_{125x}$ and $R_{125y}$ form a combination selected from the group consisting of combinations described in (i) or (ii) below, and $A_{125}$ and $R_{125}$ form a combination selected from the group consisting of combinations described in (i-A) in the case of (i), or $A_{125}$ and $R_{125}$ form a combination selected from the group consisting of combinations described in (ii-A) in the case of (ii), the combinations wherein (i) $R_{125w}$ and $R_{125x}$ are a hydrogen atom, and $R_{125y}$ is a $CH_3$ group or a hydrogen atom;

(i-A) $A_{125}$ is a linear or branched alkylene group having 1 to 8 carbon atoms, $R_{125}$ is a halogen atom or $OR_{125a}$, and $R_{125a}$ is a linear or branched alkyl group having 1 to 8 carbon atoms, or a substituted or unsubstituted phenyl group;

(ii) $R_{125w}$ and $R_{125x}$ are independently a halogen atom or a hydrogen atom, $R_{125y}$ is a $CH_3$ group, a halogen atom or a hydrogen atom, and at least one of $R_{125w}$, $R_{125x}$ and $R_{125y}$ are a halogen atom; or (ii-A) $A_{125}$ is a linear or branched alkylene group having 1 to 8 carbon atoms, $R_{125}$ is OH, a halogen atom, ONa, OK or $OR_{125a}$, and $R_{125a}$ is a linear or branched alkyl group having 1 to 8 carbon atoms, or a substituted or unsubstituted phenyl group.

3. The resin-coated carrier according to claim 1, wherein the structure represented by the formula (1) is a unit represented by the formula (3):

(3)

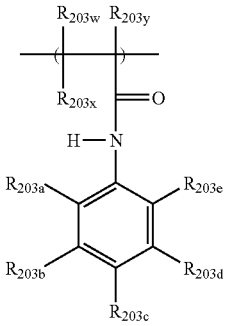

wherein $R_{203w}$ and $R_{203x}$ are independently a halogen atom or a hydrogen atom, $R_{203y}$ is a $CH_3$ group, a halogen atom or a hydrogen atom, at least one of $R_{203a}$, $R_{203b}$, $R_{203c}$, $R_{203d}$ and $R_{203e}$ is $SO_2R_{203f}$, wherein $R_{203f}$ is OH, a halogen atom, ONa, OK or $OR_{203h}$, and $R_{203h}$ represents a linear or branched alkyl group having 1 to 8 carbon atoms, or a substituted or unsubstituted phenyl group, and the others of $R_{203a}$, $R_{203b}$, $R_{203c}$, $R_{203d}$ and $R_{203e}$ are selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{203g}$, wherein $R_{203g}$ represents any of an H atom, a Na atom and a K atom, an acetoamide group, an OPh group, an NHPh group, a $CF_3$ group, a $C_2F_5$ group and a $C_3F_7$ group.

4. The resin-coated carrier according to claim 1, wherein the structure represented by the formula (1) is any of a unit represented by the formula (4a):

(4a)

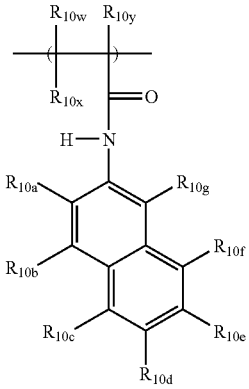

wherein $R_{10w}$ and $R_{10x}$ are independently a halogen atom or a hydrogen atom, $R_{10y}$ is a $CH_3$ group, a halogen atom or a hydrogen atom, at least one of $R_{10a}$, $R_{10b}$, $R_{10c}$, $R_{10d}$, $R_{10e}$, $R_{10f}$ and $R_{10g}$ is $SO_2R_{10o}$, wherein $R_{10o}$ is OH, a halogen atom, ONa, OK or $OR_{10s}$, and $R_{10s}$ represents a linear or branched alkyl group having 1 to 8 carbon atoms, or a substituted or unsubstituted phenyl group, and the others of $R_{10a}$, $R_{10b}$, $R_{10c}$, $R_{10d}$, $R_{10e}$, $R_{10f}$ and $R_{10g}$ are selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{10p}$, wherein $R_{10p}$ represents any of an H atom, a Na atom and a K atom, an acetoamide group, an OPh group, an NHPh group, a $CF_3$ group, a $C_2F_5$ group and a $C_3F_7$ group, and a unit represented by the formula (4b):

(4b)

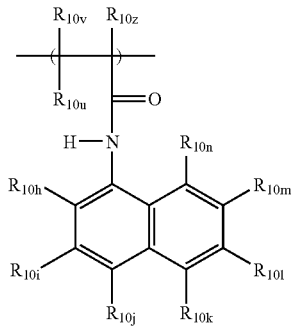

wherein $R_{10v}$ and $R_{10u}$ are independently a halogen atom or a hydrogen atom, $R_{10z}$ is a $CH_3$ group, a halogen atom or a hydrogen atom, at least one of $R_{10h}$, $R_{10i}$, $R_{10j}$, $R_{10k}$, $R_{10l}$, $R_{10m}$ and $R_{10n}$ is $SO_2R_{10q}$, wherein $R_{10q}$ is OH, a halogen atom, ONa, OK or $OR_{10r}$, and $R_{10r}$ represents a linear or branched alkyl group having 1 to 8 carbon atoms, or a substituted or unsubstituted phenyl group, and the others of $R_{10h}$, $R_{10i}$, $R_{10j}$, $R_{10k}$, $R_{10l}$, $R_{10m}$ and $R_{10n}$ are selected from the group consisting of a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{10r}$, wherein $R_{10r}$ represents any of an H atom, a Na atom and a K atom, an acetoamide group, an OPh group, an NHPh group, a $CF_3$ group, a $C_2F_5$ group and a $C_3F_7$ group.

5. The resin-coated carrier according to claim 1, wherein the polymer comprises, in addition to a unit represented by the formula (1), at least one unit derived from a vinyl monomer which is represented by the formula (5):

(5)

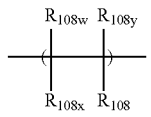

wherein $R_{108w}$ and $R_{108x}$ are independently a halogen atom or a hydrogen atom, $R_{108y}$ is a $CH_3$ group, a halogen atom or a hydrogen atom, $R_{108}$ is any of a hydrogen atom, a substituted or unsubstituted aliphatic hydrocarbon structure, a substituted or unsubstituted aromatic ring structure, a substituted or unsubstituted heterocyclic structure, a halogen atom, —$COR_{108a}$, —$OR_{108b}$, —$COOR_{108c}$, —$OCOR_{108d}$, —$CONR_{108e}R_{108f}$, —CN and a cyclic structure containing an N atom, and $R_{108a}$, $R_{108b}$, $R_{108c}$, $R_{108d}$, $R_{108e}$ and $R_{108f}$ are independently any of a hydrogen atom, a substituted or unsubstituted aliphatic hydrocarbon structure, a substituted or unsubstituted aromatic ring structure, or a substituted or unsubstituted heterocyclic structure.

6. The resin-coated carrier according to claim 1, wherein the polymer has a number average molecular weight set in the range of 1,000 to 1,000,000.

7. A two-component developer which comprises a resin-coated carrier and a toner comprising at least a binder resin and a colorant, wherein the resin-coated carrier is a resin-coated carrier according to any of claims 1 to 6.

8. A developer for replenishment which comprises 1 part by weight of a carrier and 2 to 50 parts by weight of a toner based on the carrier, wherein the carrier is a resin-coated carrier according to any of claims 1 to 6.

* * * * *